US011047112B2

(12) United States Patent
Jimbo et al.

(10) Patent No.: US 11,047,112 B2
(45) Date of Patent: Jun. 29, 2021

(54) CONTROL SYSTEM, WORK MACHINE, AND CONTROL METHOD

(71) Applicant: Komatsu Ltd., Tokyo (JP)

(72) Inventors: Shimon Jimbo, Tokyo (JP); Kenichi Kitamura, Tokyo (JP); Yoshihiro Kumagae, Tokyo (JP)

(73) Assignee: Komatsu Ltd., Tokyo (JP)

( * ) Notice: Subject to any disclaimer, the term of this patent is extended or adjusted under 35 U.S.C. 154(b) by 321 days.

(21) Appl. No.: 15/741,541

(22) PCT Filed: Jul. 27, 2017

(86) PCT No.: PCT/JP2017/027340

§ 371 (c)(1),
(2) Date: Jan. 3, 2018

(87) PCT Pub. No.: WO2017/188460

PCT Pub. Date: Nov. 2, 2017

(65) Prior Publication Data

US 2019/0032306 A1 Jan. 31, 2019

(51) Int. Cl.
*E02F 9/22* (2006.01)
*F15B 11/17* (2006.01)
(Continued)

(52) U.S. Cl.
CPC ..... *E02F 9/2203* (2013.01); *E02F 3/431* (2013.01); *E02F 9/2221* (2013.01);
(Continued)

(58) Field of Classification Search
CPC .. F15B 2211/20576; F15B 2211/20546; F15B 2211/6309; F15B 11/17; F15B 2211/20523; F15B 2211/6313
See application file for complete search history.

(56) References Cited

U.S. PATENT DOCUMENTS 9,394,671 B2 * 7/2016 Hirozawa ..... E02F 9/2285
9,702,121 B2 * 7/2017 Tanaka ..... G07C 5/0808
(Continued)

FOREIGN PATENT DOCUMENTS

CN 1878963 A 12/2006
CN 100451352 C 1/2009
(Continued)

OTHER PUBLICATIONS

International Search Report dated Sep. 12, 2017, dated for PCT/JP2017/027340.

(Continued)

*Primary Examiner* — Redhwan K Mawari
(74) *Attorney, Agent, or Firm* — Locke Lord LLP

(57) ABSTRACT

A control system includes: an engine; a first hydraulic pump and a second hydraulic pump driven by the engine; a switching device provided in a flow path that connects the first hydraulic pump to the second hydraulic pump, and configured to perform switching between a merged state in which the flow path is opened and a separated state in which the flow path is closed; a first hydraulic actuator to which hydraulic fluid discharged from the first hydraulic pump is supplied in the separated state; a second hydraulic actuator to which hydraulic fluid discharged from the second hydraulic pump is supplied in the separated state; a determining unit configured to determine whether output of the engine is limited; and a merging-separating control unit configured to control the switching device so as to perform switching to the merged state when the determining unit determines that output of the engine is limited.

18 Claims, 7 Drawing Sheets

(51) Int. Cl.

| | |
|---|---|
| ***E02F 3/43*** | (2006.01) |
| ***F02D 41/04*** | (2006.01) |
| ***F02D 41/22*** | (2006.01) |
| ***F02D 41/30*** | (2006.01) |
| ***F15B 11/04*** | (2006.01) |
| ***F15B 13/02*** | (2006.01) |
| *F15B 21/08* | (2006.01) |

(52) U.S. Cl.

CPC ..... *E02F 9/2242* (2013.01); *E02F 9/2246* (2013.01); *E02F 9/2292* (2013.01); *F02D 41/04* (2013.01); *F02D 41/222* (2013.01); *F02D 41/30* (2013.01); *F15B 11/04* (2013.01); *F15B 11/17* (2013.01); *F15B 13/02* (2013.01); *F02D 2200/08* (2013.01); *F02D 2250/26* (2013.01); *F15B 21/087* (2013.01); *F15B 2211/20523* (2013.01); *F15B 2211/20546* (2013.01); *F15B 2211/20576* (2013.01); *F15B 2211/30595* (2013.01); *F15B 2211/40* (2013.01); *F15B 2211/633* (2013.01); *F15B 2211/6309* (2013.01); *F15B 2211/6313* (2013.01); *F15B 2211/6316* (2013.01); *F15B 2211/6651* (2013.01); *F15B 2211/6652* (2013.01); *F15B 2211/7142* (2013.01); *F15B 2211/86* (2013.01)

(56) References Cited

U.S. PATENT DOCUMENTS

| | | | | |
|---|---|---|---|---|
| 9,758,946 | B2 * | 9/2017 | Yogita | E02F 9/2235 |
| 10,109,123 | B2 * | 10/2018 | Matsuzaki | A01B 1/00 |
| 10,378,414 | B2 * | 8/2019 | Uehara | F01N 11/00 |
| 2006/0173608 | A1 * | 8/2006 | Shimura | F02D 41/266 701/114 |
| 2006/0230752 | A1 * | 10/2006 | Sawada | F15B 11/024 60/431 |
| 2007/0125078 | A1 * | 6/2007 | Tanaka | F15B 11/17 60/421 |
| 2009/0056324 | A1 * | 3/2009 | Itakura | E02F 9/2242 60/421 |
| 2012/0185141 | A1 * | 7/2012 | Kamado | E02F 9/2292 701/50 |
| 2014/0138177 | A1 * | 5/2014 | Yoshida | E02F 3/325 180/307 |
| 2015/0217653 | A1 * | 8/2015 | Ogawa | H02J 7/02 320/109 |
| 2015/0246613 | A1 * | 9/2015 | Shimazu | G07C 5/0808 701/102 |
| 2016/0040689 | A1 * | 2/2016 | Kim | E02F 9/2292 60/327 |
| 2017/0058490 | A1 | 3/2017 | Kamado et al. | |
| 2018/0030692 | A1 * | 2/2018 | Kamoshita | F15B 11/17 |
| 2019/0032306 | A1 * | 1/2019 | Jimbo | F15B 13/02 |

FOREIGN PATENT DOCUMENTS

| | | | |
|---|---|---|---|
| CN | 102483056 | A | 5/2012 |
| DE | 19753915 | A1 | 6/1998 |
| DE | 112015000143 | T5 | 6/2016 |
| JP | 51-041093 | U1 | 3/1976 |
| JP | 55-116932 | A | 9/1980 |
| JP | 08-282975 | A | 10/1996 |
| JP | 2009-150553 | A | 7/2009 |
| WO | 2005/047709 | A1 | 5/2005 |
| WO | 2006/123704 | A1 | 11/2006 |
| WO | 2015/025537 | A1 | 2/2015 |
| WO | 2017/014324 | A1 | 1/2017 |

OTHER PUBLICATIONS

Office Action dated Apr. 20, 2021, issued in the corresponding DE patent application No. 112017000037.8.

* cited by examiner

CONTROL SYSTEM, WORK MACHINE, AND CONTROL METHOD

FIELD

The present invention relates to a control system, a work machine, and a control method.

BACKGROUND

An excavator is known as a kind of work machine having a work unit. The work unit of the excavator is driven by a hydraulic cylinder. The hydraulic cylinder is actuated by hydraulic fluid discharged from a hydraulic pump. Patent Literature 1 discloses a hydraulic control device having a merging-separating valve that performs switching between a merged state in which hydraulic fluid discharged from a first hydraulic pump and hydraulic fluid discharged from a second hydraulic pump are merged and a separated state in which these two kinds of hydraulic fluid are not merged. In the separated state, a first hydraulic actuator is actuated by the hydraulic fluid discharged from the first hydraulic pump, and a second hydraulic actuator is actuated by the hydraulic fluid discharged from the second hydraulic pump.

CITATION LIST

Patent Literature

Patent Literature 1: WO 2005/047709 A1

SUMMARY

Technical Problem

Each of a first hydraulic pump and a second hydraulic pump is driven by an engine. When output of an engine is decreased, a flow rate of hydraulic fluid discharged from each of the first hydraulic pump and the second hydraulic pump is decreased. In the case where a separated state is kept when the output of the engine is decreased, the flow rate of the hydraulic fluid supplied to each of a first hydraulic actuator and a second hydraulic actuator is decreased. As a result, an actuation speed of the work unit may be decreased, and workability of the work machine may be degraded.

An aspect of the present invention is directed to providing a technique in which an actuation speed of a work unit can be prevented from being decreased when output of an engine is decreased. Solution to Problem According to an aspect of the present invention, a control system comprises: an engine; a first hydraulic pump and a second hydraulic pump driven by the engine; a switching device provided in a flow path that connects the first hydraulic pump to the second hydraulic pump, and configured to perform switching between a merged state in which the flow path is opened and a separated state in which the flow path is closed; a first hydraulic actuator to which hydraulic fluid discharged from the first hydraulic pump is supplied in the separated state; a second hydraulic actuator to which hydraulic fluid discharged from the second hydraulic pump is supplied in the separated state; a determining unit configured to determine whether output of the engine is limited; and a merging-separating control unit configured to control the switching device so as to perform switching to the merged state when the determining unit determines that output of the engine is limited.

ADVANTAGEOUS EFFECTS OF INVENTION

According to the aspect of the present invention, provided is the technique in which the actuation speed of the work unit can be prevented from being decreased when output of the engine is decreased.

DESCRIPTION OF EMBODIMENTS

In the following, an embodiment of the present invention will be described with reference to the drawings, but the present invention is not limited thereto. Note that components of each embodiment described hereafter can be suitably combined. Additionally, there may be a case where some of the components are not used.

[Work Machine]

Figure 1:
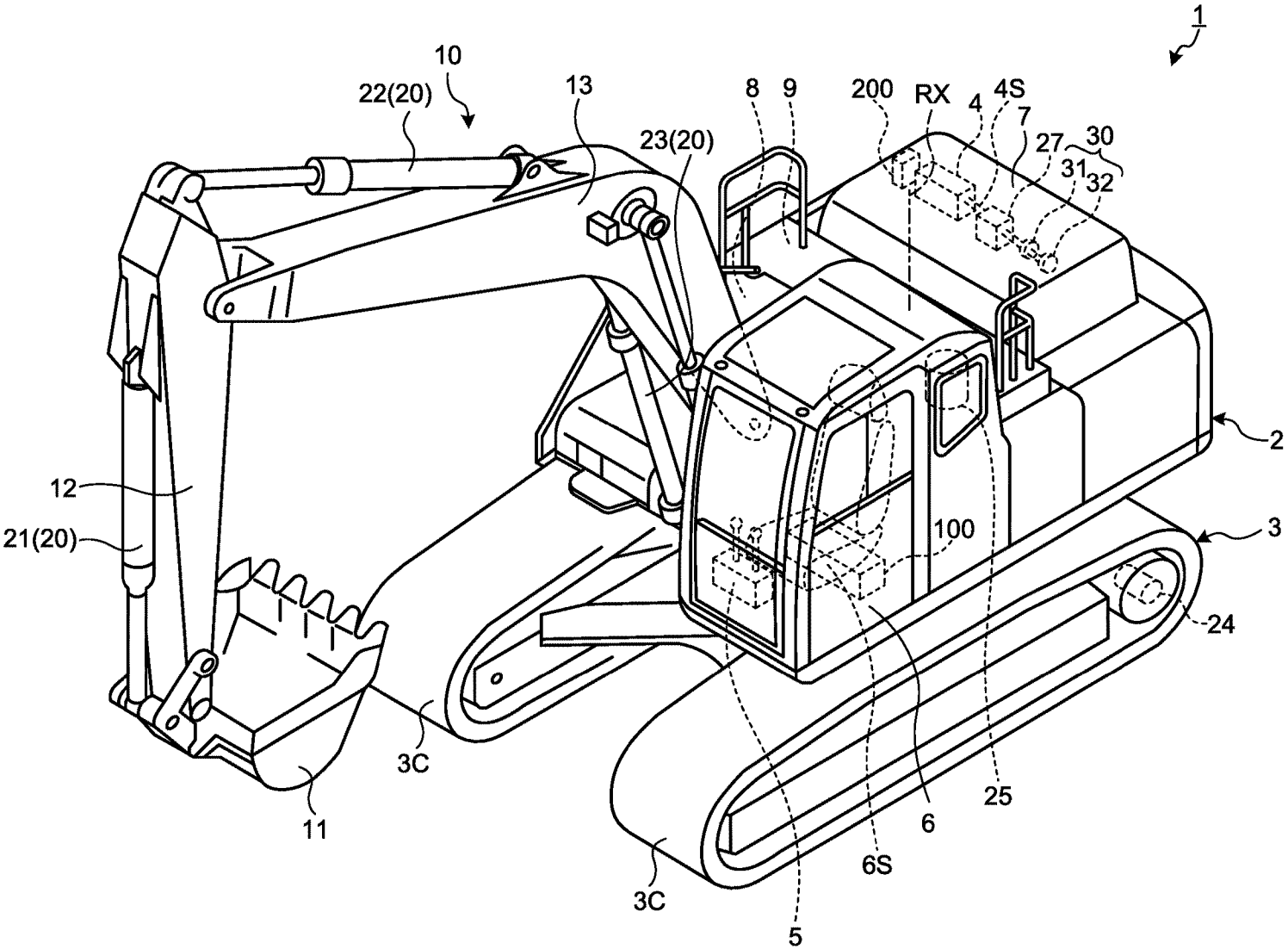
FIG. 1 is a perspective view illustrating an exemplary work machine according to the present embodiment.

FIG. 1 is a perspective view illustrating an exemplary work machine 1 according to the present embodiment. In the present embodiment, it is assumed that the work machine 1 is an excavator of a hybrid system. In the following description, the work machine 1 will be referred to as an excavator 1 as appropriate.

As illustrated in FIG. 1, the excavator 1 includes a work unit 10, an upper swing body 2 that supports the work unit 10, a lower traveling body 3 that supports the upper swing body 2, an engine 4, a generator motor 27 driven by the engine 4, a hydraulic pump 30 driven by the engine 4, a hydraulic cylinder 20 that actuates the work unit 10, an electric motor 25 that swings the upper swing body 2, a hydraulic motor 24 that causes the lower traveling body 3 to travel, an operation device 5 configured to operate the work unit 10, a control device 100, and an exhaust gas treatment device 200 that treats an exhaust gas of the engine 4.

The engine 4 is an internal combustion engine that is a power source of the excavator 1. The engine 4 has an output shaft 4S connected to the generator motor 27 and the hydraulic pump 30. The engine 4 is, for example, a diesel engine. The engine 4 is housed in a machine room 7 of the upper swing body 2.

The generator motor 27 is connected to the output shaft 4S of the engine 4, and generates power by actuation of the engine 4. The generator motor 27 is, for example, a switched reluctance motor. Note that the generator motor 27 may also be a permanent magnet (PM) motor.

The hydraulic pump 30 is connected to the output shaft 4S of the engine 4, and discharges hydraulic fluid by actuation of the engine 4. In the present embodiment, the hydraulic pump 30 is connected to the output shaft 4S, and includes: a first hydraulic pump 31 driven by the engine 4; and a second hydraulic pump 32 connected to the output shaft 4S and driven by the engine 4. The hydraulic pump 30 is housed in the machine room 7 of the upper swing body 2.

The work unit 10 is supported by the upper swing body 2. The work unit 10 includes a plurality of work unit elements which are movable relative to each other. The work unit elements of the work unit 1 includes a bucket 11, an arm 12 connected to the bucket 11, and a boom 13 connected to the arm 12. The bucket 11 is rotatably connected to a distal end portion of the arm 12. The arm 12 is rotatably connected to a distal end portion of the boom 13. The boom 13 is rotatably connected to the upper swing body 2.

The hydraulic cylinder 20 is actuated by hydraulic fluid supplied from the hydraulic pump 30. The hydraulic cylinder 20 is a hydraulic actuator that generates power to actuate the work unit 10. The work unit 10 can be actuated by the power generated by the hydraulic cylinder 20. The hydraulic cylinder 20 includes a bucket cylinder 21 to actuate a bucket 11, an arm cylinder 22 to actuate an arm 12, and a boom cylinder 23 to actuate a boom 13.

The electric motor 25 is actuated by power supplied from the generator motor 27. The electric motor 25 is an electric actuator that generates power to swing the upper swing body 2. The upper swing body 2 can swing about a swing shaft RX by the power generated by the electric motor 25.

The hydraulic motor 24 is actuated by hydraulic fluid supplied from the hydraulic pump 30. The hydraulic motor 24 is a hydraulic actuator that generates power to cause the lower traveling body 3 to travel. A crawler belt 3C of the lower traveling body 3 can be rotated by the power generated by the hydraulic motor 24.

The upper swing body 2 has a fuel tank 8 to store fuel and a hydraulic fluid tank 9 to store hydraulic fluid. The fuel stored in the fuel tank 8 is supplied to the engine 4. The hydraulic fluid stored in the hydraulic fluid tank 9 is supplied to the hydraulic cylinder 20 and the hydraulic motor 24 via the hydraulic pump 30.

The operation device 5 is arranged in an operating room 6. The operation device 5 is operated in order to drive each of the hydraulic cylinder 20 and the hydraulic motor 24. The operation device 5 includes an operating member to be operated by an operator of the excavator 1. The operating member includes an operating lever or a joystick. When the operation device 5 is operated, the work unit 10 is actuated.

[Control System]

Figure 2:
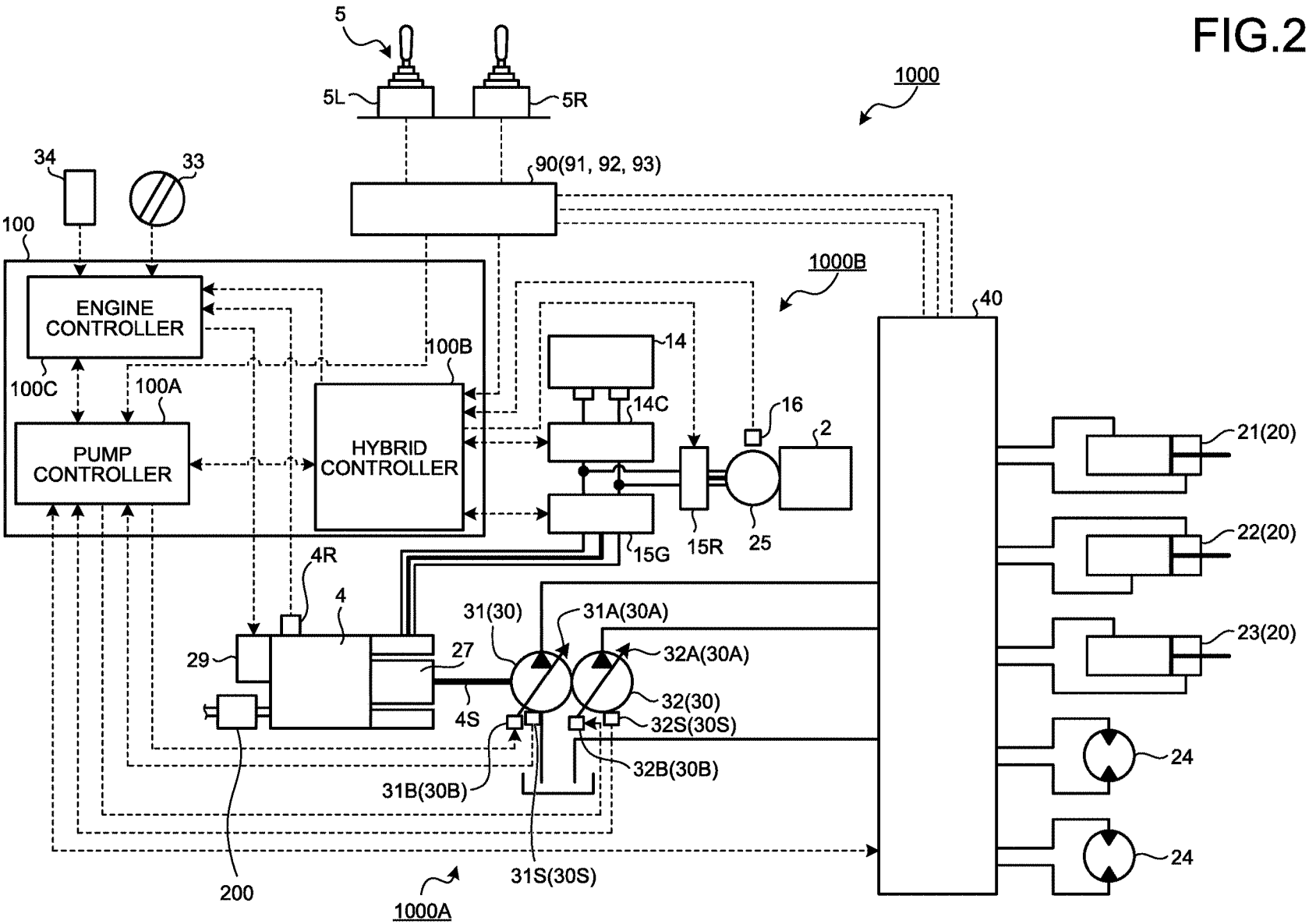
FIG. 2 is a diagram schematically illustrating an exemplary control system according to the present embodiment.

FIG. 2 is a diagram schematically illustrating an exemplary control system 1000 according to the present embodiment. The control system 1000 is mounted on the excavator 1 and controls the excavator 1. The control system 1000 includes a control device 100, a hydraulic system 1000A, and an electric system 1000B.

The hydraulic system 1000A has the hydraulic pump 30, a hydraulic circuit 40 where hydraulic fluid discharged from the hydraulic pump 30 flows, the hydraulic cylinder 20 actuated by hydraulic fluid supplied from the hydraulic pump 30 via the hydraulic circuit 40, and the hydraulic motor 24 actuated by hydraulic fluid supplied from the hydraulic pump 30 via the hydraulic circuit 40.

The output shaft 4S of the engine 4 is connected to the hydraulic pump 30. When the engine 4 is driven, the hydraulic pump 30 is actuated. The hydraulic cylinder 20 and the hydraulic motor 24 are actuated on the basis of the hydraulic fluid discharged from the hydraulic pump 30. An engine speed sensor 4R that detects an engine speed [rpm] of the engine 4 is provided in the engine 4.

The hydraulic pump 30 is a variable displacement hydraulic pump. In the present embodiment, the hydraulic pump 30 is a swash plate hydraulic pump. A swash plate 30A of the hydraulic pump 30 is driven by a servo mechanism 30B. A capacity [cc/rev] of the hydraulic pump 30 is adjusted by adjusting an angle of the swash plate 30A by the servo mechanism 30B. The capacity of the hydraulic pump 30 represents a discharge amount [cc/rev] of the hydraulic fluid discharged from the hydraulic pump 30 when the output shaft 4S of the engine 4 connected to the hydraulic pump 30 is rotated once.

In the present embodiment, the swash plate 30A of the hydraulic pump 30 includes a swash plate 31A of the first hydraulic pump 31 and a swash plate 32A of the second hydraulic pump 32. The servo mechanism 30B includes: a servo mechanism 31B to adjust an angle of the swash plate 31A of the first hydraulic pump 31; and a servo mechanism 32B to adjust an angle of the swash plate 32A of the second hydraulic pump 32.

The electric system 1000B has the generator motor 27, a storage battery 14, a transformer 14C, a first inverter 15G, a second inverter 15R, and the electric motor 25 actuated by the power supplied from the generator motor 27.

The output shaft 4S of the engine 4 is connected to the generator motor 27. When the engine 4 is driven, the generator motor 27 is actuated. When the engine 4 is driven, a rotor of the generator motor 27 is rotated. The generator motor 27 generates power by rotation of the rotor of the generator motor 27. Meanwhile, the generator motor 27 may also be connected to the output shaft 4S of the engine 4 via a power transmission mechanism such as a power take off (PTO).

The electric motor 25 is actuated on the basis of power output from the generator motor 27. The electric motor 25 generates power to swing the upper swing body 2. A rotation sensor 16 is provided at the electric motor 25. The rotation sensor 16 includes, for example, a resolver or a rotary encoder. The rotation sensor 16 detects a rotation angle or a rotation speed of the electric motor 25.

The operating room 6 is provided with the operation device 5, a throttle dial 33, and a work mode selector 34 which are operated by an operator.

The operation device 5 includes an operating member to operate the lower traveling body 3, an operating member to operate the upper swing body 2, and an operating member to operate the work unit 10. The hydraulic motor 24 that causes the lower traveling body 3 to travel is actuated on the basis of operation of the operation device 5. The electric motor 25 that swings the upper swing body 2 is actuated on the basis of operation of the operation device 5. The hydraulic cylinder 20 that actuates the work unit 10 is actuated on the basis of operation of the operation device 5.

In the present embodiment, the operation device 5 includes: a right operating lever 5R arranged on a right side of an operator seated on an operator's seat 6S; and a left operating lever 5L arranged on a left side thereof.

Further, the operation device 5 has a travel lever (not illustrated). A travel motor 24 is driven by operating the travel lever.

The control system 1000 has an operation amount sensor 90 that detects an operation amount of the operation device 5. The operation amount sensor 90 includes: a bucket operation amount sensor 91 that detects an operation amount of the operation device 5 operated in order to drive the bucket cylinder 21 that actuates the bucket 11; an arm operation amount sensor 92 that detects an operation amount of the operation device 5 operated in order to drive the arm cylinder 22 that actuates the arm 12; and a boom operation amount sensor 93 that detects an operation amount of the operation device 5 operated in order to drive the boom cylinder 23 that actuates the boom 13.

The throttle dial 33 is an operating member to set a fuel injection amount to be injected to the engine 4. An upper limit engine speed Nmax [rpm] of the engine 4 is set by the throttle dial 33.

The work mode selector 34 is an operating member to set an output characteristic of the engine 4. Maximum output [kW] of the engine 4 is set by the work mode selector 34.

The control device 100 includes a computer system. The control device 100 has an arithmetic processing device including a processor such as a central processing unit (CPU), a storage device including a memory such as a read only memory (ROM) or a random access memory (RAM), and an input/output interface device. The control device 100 outputs command signals to control the hydraulic system 1000A and the electric system 1000B. In the present embodiment, the control device 100 includes a pump controller 100A to control the hydraulic system 1000A, a hybrid controller 100B to control the electric system 1000B, and an engine controller 100C to control the engine 4.

The pump controller 100A outputs a command signal to control the first hydraulic pump 31 and the second hydraulic pump 32 on the basis of at least one of a command signal transmitted from the hybrid controller 100B, a command signal transmitted from the engine controller 100C, and a detection signal transmitted from the operation amount sensor 90.

In the present embodiment, the pump controller 100A outputs a command signal to adjust the capacity [cc/rev] of the hydraulic pump 30. The pump controller 100A adjusts the capacity [cc/rev] of the hydraulic pump 30 by outputting a command signal to the servo mechanism 30B and controlling the angle of the swash plate 30A of the hydraulic pump 30. The hydraulic pump 30 has a swash plate angle sensor 30S that detects the angle of the swash plate 30A. The inclination angle sensor 30S includes an inclination angle sensor 31S to detect the angle of the swash plate 31A and an inclination angle sensor 32S to detect the angle of the swash plate 32A. A detection signal of the swash plate angle sensor 30S is output to the pump controller 100A. The pump controller 100A controls the angle of the swash plate 30A by outputting a command signal to the servo mechanism 30B on the basis of the detection signal of the swash plate angle sensor 30S.

The hydraulic pump 30 is driven by the engine 4. When the engine speed [rpm] of the engine 4 is increased and the engine speed per unit time of the output shaft 4S of the engine 4 connected to the hydraulic pump 30 is increased, a discharge flow rate Q [1/min] of hydraulic fluid discharged from the hydraulic pump 30 per unit time is increased. When the engine speed [rpm] of the engine 4 is decreased and the engine speed per unit time of the output shaft 4S of the engine 4 connected to the hydraulic pump 30 is decreased, a discharge flow rate Q [1/min] of hydraulic fluid discharged from the hydraulic pump 30 per unit time is decreased.

When the engine 4 is driven at a maximum engine speed [rpm] in a state in which the hydraulic pump 30 is adjusted to a maximum capacity [cc/rev], the hydraulic pump 30 discharges hydraulic fluid at a maximum discharge flow rate Qmax [1/min].

In the present embodiment, the pump controller 100A outputs a command signal to adjust each of a capacity [cc/rev] of the first hydraulic pump 31 and a capacity [cc/rev] of the second hydraulic pump 32.

The pump controller 100A outputs a command signal to the servo mechanism 31B on the basis of a detection signal of the swash plate angle sensor 31S and controls the angle of the swash plate 31A of the first hydraulic pump 31, thereby adjusting the capacity [cc/rev] of the first hydraulic pump 31. The pump controller 100A outputs a command signal to the servo mechanism 32B on the basis of a detection signal of the swash plate angle sensor 32S and controls the angle of the swash plate 32A of the second hydraulic pump 32, thereby adjusting the capacity [cc/rev] of the second hydraulic pump 32.

The discharge flow rate Q [1/min] of the hydraulic fluid discharged from the hydraulic pump 30 includes: a discharge flow rate Q1 [1/min] of the hydraulic fluid discharged from the first hydraulic pump 31; and a discharge flow rate Q2 [1/min] of the hydraulic fluid discharged from the second hydraulic pump 32. When the engine speed of the engine 4 is increased and the engine speed per unit time of the output shaft 4S of the engine 4 connected to the first hydraulic pump 31 and the second hydraulic pump 32 is increased, the discharge flow rate Q1 [1/min] of the first hydraulic pump 31 and the discharge flow rate Q2 [1/min] of the second hydraulic pump 32 are increased. When the engine speed of the engine 4 is decreased and the engine speed per unit time of the output shaft 4S of the engine 4 connected to the first hydraulic pump 31 and the second hydraulic pump 32 is decreased, the discharge flow rate Q1 [1/min] of the first hydraulic pump 31 and the discharge flow rate Q2 [1/min] of the second hydraulic pump 32 are decreased.

The maximum discharge flow rate Qmax [1/min] of the hydraulic pump 30 includes: a maximum discharge flow rate Q1max [1/min] of the first hydraulic pump 31; and a maximum discharge flow rate Q2max [1/min] of the second hydraulic pump 32. When the engine 4 is driven at the maximum engine speed with the first hydraulic pump 31 adjusted to the maximum capacity [cc/rev], the first hydraulic pump 31 discharges hydraulic fluid with the maximum discharge flow rate Q1max. Similarly, when the engine 4 is driven at the maximum engine speed with the second hydraulic pump 32 adjusted to the maximum capacity [cc/rev], the second hydraulic pump 32 discharges the hydraulic fluid at the maximum discharge flow rate Q2max. In the present embodiment, the maximum discharge flow rate Q1max and the maximum discharge flow rate Q2max are equal.

The hybrid controller 100B controls the electric motor 25 on the basis of a detection signal of the rotation sensor 16. The electric motor 25 is actuated on the basis of power supplied from the generator motor 27 or the storage battery 14. In the present embodiment, the hybrid controller 100B performs: control for power transfer among the transformer 14C, the first inverter 15G, and the second inverter 15R; and control for power transfer between the transformer 14C and the storage battery 14.

Furthermore, the hybrid controller 100B controls a temperature in each of the generator motor 27, electric motor 25, storage battery 14, first inverter 15G, and second inverter 15R on the basis of a detection signal of a temperature sensor provided in each of the generator motor 27, electric motor 25, storage battery 14, first inverter 15G, and second inverter 15R. Additionally, the hybrid controller 100B performs: control for charge/discharge of the storage battery 14; control for the generator motor 27;

and assist control for the engine 4 by the generator motor 27.

The engine controller 100C generates a command signal on the basis of a setting value of the throttle dial 33 and outputs the same to a common rail control unit 29 provided in the engine 4. The common rail control unit 29 adjusts a fuel injection amount to the engine 4 on the basis of a command signal transmitted from the engine controller 100C.

[Engine and Exhaust Gas Treatment Device]

Figure 3:
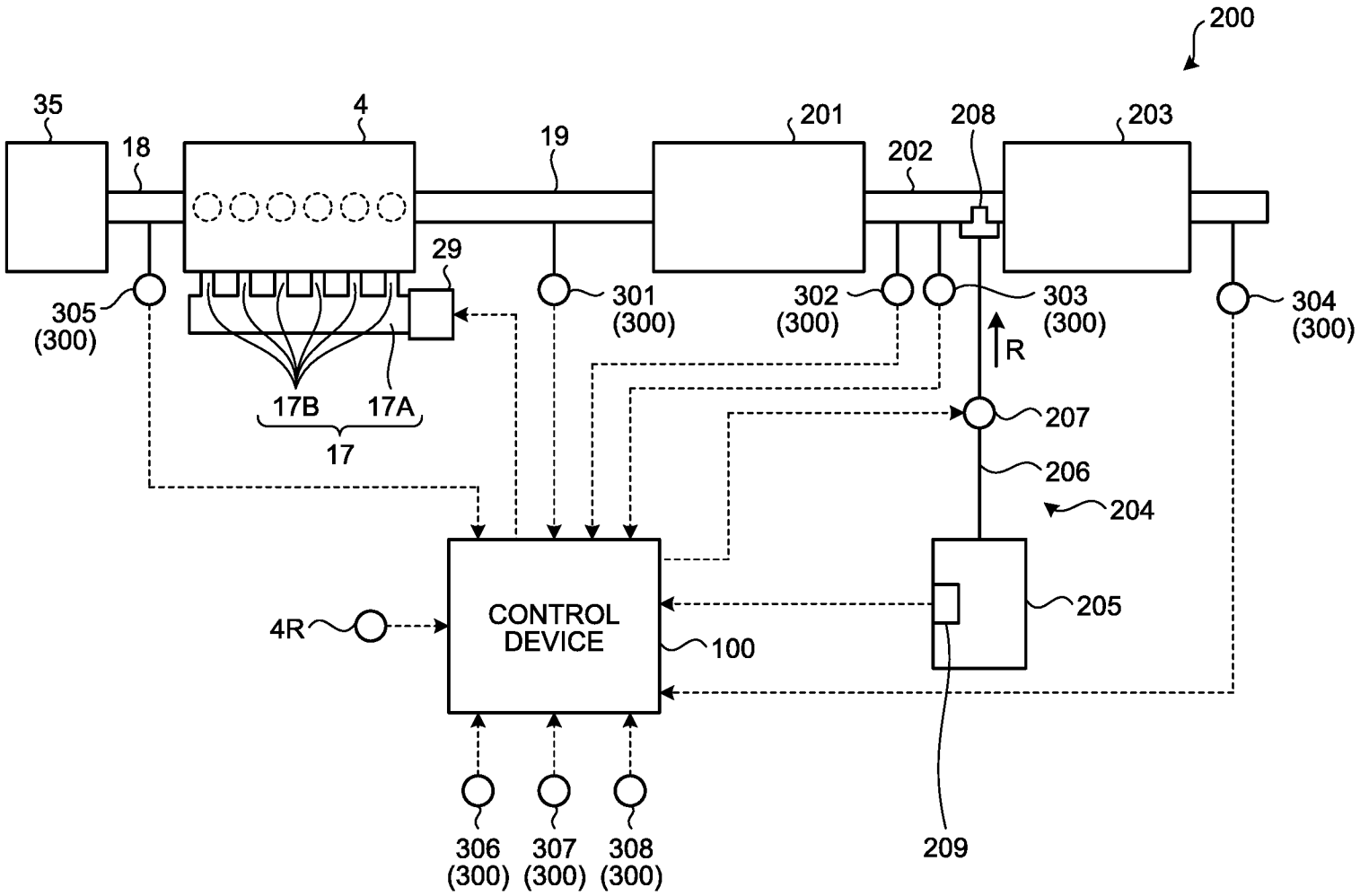
FIG. 3 is a diagram schematically illustrating an exemplary engine and an exemplary exhaust gas treatment device according to the present embodiment.

FIG. 3 is a diagram schematically illustrating an exemplary engine 4 and an exemplary exhaust gas treatment device 200 according to the present embodiment. The exhaust gas treatment device 200 treats an exhaust gas of the engine 4. In the present embodiment, the exhaust gas treatment device 200 includes a urea selective catalytic reduction (SCR) system to reduce and purify nitrogen oxides (NOx) contained in the exhaust gas by utilizing a selective catalyst and a reducing agent.

The engine 4 has a fuel injection device 17. The fuel injection device 17 injects fuel to a combustion chamber of the engine 4. In the present embodiment, the fuel injection device 17 is a common rail system including an accumulator 17A and an injector 17B. The fuel injection device 17 is controlled by a control device 50 via the common rail control unit 29.

The engine 4 is connected to each of an intake pipe 18 and an exhaust pipe 19. An inlet of the intake pipe 18 is connected to an air cleaner 35 that collects a foreign matter in the air. An outlet of the intake pipe 18 is connected to an intake port of the engine 4. The exhaust gas treatment device 200 is connected to an exhaust port of the engine 4 via the exhaust pipe 19.

The exhaust gas treatment device 200 purifies the exhaust gas discharged from the engine 4. The exhaust gas treatment device 200 decreases nitrogen oxides (NOx) contained in the exhaust gas. The exhaust gas treatment device 20 includes: a filter unit 201 connected to the exhaust pipe 19 and configured to collect particulates contained in the exhaust gas; a reducing catalyst 203 connected to the filter unit 201 via a pipe line 202 and configured to reduce NOx contained in the exhaust gas; and a reducing agent supply device 204 to supply a reducing agent R.

The filter unit 201 includes a diesel particulate filter (DPF) and collects the particulates contained in the exhaust gas.

The reducing catalyst 203 reduces NOx contained in the exhaust gas by the reducing agent R supplied from the reducing agent supply device 204. The reducing catalyst 203 converts NOx into nitrogen and water by the reducing agent R. For example, a vanadium catalyst or a zeolite catalyst is used as the reducing catalyst 203.

The reducing agent supply device 204 supplies the reducing agent R to the pipe line 202. The reducing agent R is urea (aqueous urea). The reducing agent supply device 204 includes: a reducing agent tank 205 to store the reducing agent R; a supply pipe 206 connected to the reducing agent tank 205; a supply pump 207 provided in the supply pipe 206; and an injection nozzle 208 connected to the supply pipe 207. The supply pump 207 pumps the reducing agent R stored in the reducing agent tank 205 to the injection nozzle 208. The injection nozzle 208 injects the reducing agent R supplied from the reducing agent tank 205 to the inside of the pipe line 202.

A supply amount (injection amount) of the reducing agent R by the reducing agent supply device 204 is controlled by the control device 100. The reducing agent R supplied to the inside of the pipe line 202 is decomposed by heat of the exhaust gas, and changed into ammonia. In the paraphrase catalyst 203, NOx and ammonia cause catalytic reaction and are converted into nitrogen and water.

In the present embodiment, a reducing agent sensor 209 that detects an amount (liquid level) of the reducing agent R is provided in the reducing agent tank 205 of the reducing agent supply device 204.

Furthermore, in the present embodiment, the control system 1000 includes an exhaust gas sensor 300 in order to detect a state of the engine 4. The exhaust gas sensor 300 detects the state of the engine 4 by detecting a state of the exhaust gas from the engine 4. The state of the exhaust gas includes at least one of a concentration of NOx contained in the exhaust gas, a pressure of the exhaust gas, a temperature of the exhaust gas, and a flow rate of the exhaust gas. The reducing agent supply device 204 adjusts a supply amount of the reducing agent R to be supplied to the reducing catalyst 203 on the basis of a detection signal of the exhaust gas sensor 300.

In the present embodiment, the exhaust gas sensor 300 includes an NOx sensor 301 that detects a concentration of NOx contained in an exhaust gas, a pressure sensor 302 and a pressure sensor 304 each of which detects a pressure of the exhaust gas, and a temperature sensor 303 that detects a temperature of the exhaust gas.

The NOx sensor 301 detects the concentration of NOx in an exhaust gas in the exhaust pipe 19. The pressure sensor 302 detects a pressure of an exhaust gas in the pipe line 202. The temperature sensor 303 detects a temperature of the exhaust gas in the pipe line 202. The pressure sensor 304 detects a pressure of an exhaust gas having passed through the reducing catalyst 203.

Additionally, the exhaust gas sensor 300 includes an intake air flow rate sensor 305 that detects a flow rate of the air taken into the engine 4 via the intake pipe 18. The flow rate of the exhaust gas is determined on the basis of the flow rate of the air taken into the engine 4. The intake air flow rate sensor 305 functions as an exhaust gas flow rate sensor.

A detection signal of the NOx sensor 301, a detection signal of the pressure sensor 302, a detection signal of the temperature sensor 303, a detection signal of the pressure sensor 304, and a detection signal of the intake air flow rate sensor 305 are output to the control device 100.

The control device 100 controls the supply amount of the reducing agent R to be supplied to the reducing catalyst 203 on the basis of at least the detection signal of the NOx sensor 301 and the detection signal of the pressure sensor 302. For example, the control device 100 calculates a flow rate of the exhaust gas supplied from the pipe line 202 to the reducing catalyst 203 on the basis of the detection signal of the pressure sensor 302. The control device 100 calculates a flow rate of NOx in the pipe line 202 on the basis of the flow rate of the exhaust gas in the pipe line 202 and the concentration of NOx in the exhaust gas detected by the NOx sensor 301. The control device 100 determines the supply amount of the reducing agent R to be supplied to the reducing catalyst 203 on the basis of the flow rate of NOx in the pipe line 202.

Meanwhile, the control device 100 may calculate the flow rate of the exhaust gas in the pipe line 202 on the basis of the detection signal of the intake air flow rate sensor 305 and a fuel injection amount supplied from the fuel injection device 17 to the engine 4.

Meanwhile, the control device 100 may also control the supply amount of the reducing agent R to be supplied to the reducing catalyst 203 on the basis of the detection signal of the NOx sensor 301, detection signal of the pressure sensor 302, detection signal of the temperature sensor 303, and detection signal of the pressure sensor 304.

Furthermore, the exhaust gas sensor 300 includes an atmospheric pressure sensor 306, an outside air temperature sensor 307, and a coolant temperature sensor 308. The atmospheric pressure sensor 306 detects an atmospheric pressure which is an environmental pressure at which the engine 4 and the exhaust gas treatment device 200 are used. Detects an outside air temperature which is an environmental temperature at which the engine 4 and the exhaust gas treatment device 200 are used. The coolant temperature sensor 308 detects a temperature of coolant that cools the engine 4.

The NOx sensor 301 requires a certain period to be able to detect NOx after the engine 4 is started and the NOx sensor 301 is started. The NOx sensor 301 is required to keep a sensing portion at a high temperature due to a structure thereof. That is why the certain period is required for the NOx sensor 301 to be able to detect a concentration of NOx after the engine 4 is started. During a period in which the concentration of NOx cannot be detected by using the NOx sensor 301, the control device 100 estimates the concentration of NOx on the basis of a detection signal of the engine speed sensor 4R, a detection signal of the atmospheric pressure sensor 306, a detection signal of the outside air temperature sensor 307, and a detection signal of the coolant temperature sensor 308, and controls the supply amount of the reducing agent R to be supplied from the reducing agent supply device 204 to the reducing catalyst 203 on the basis of the estimated NOx concentration.

[Hydraulic System]

Figure 4:
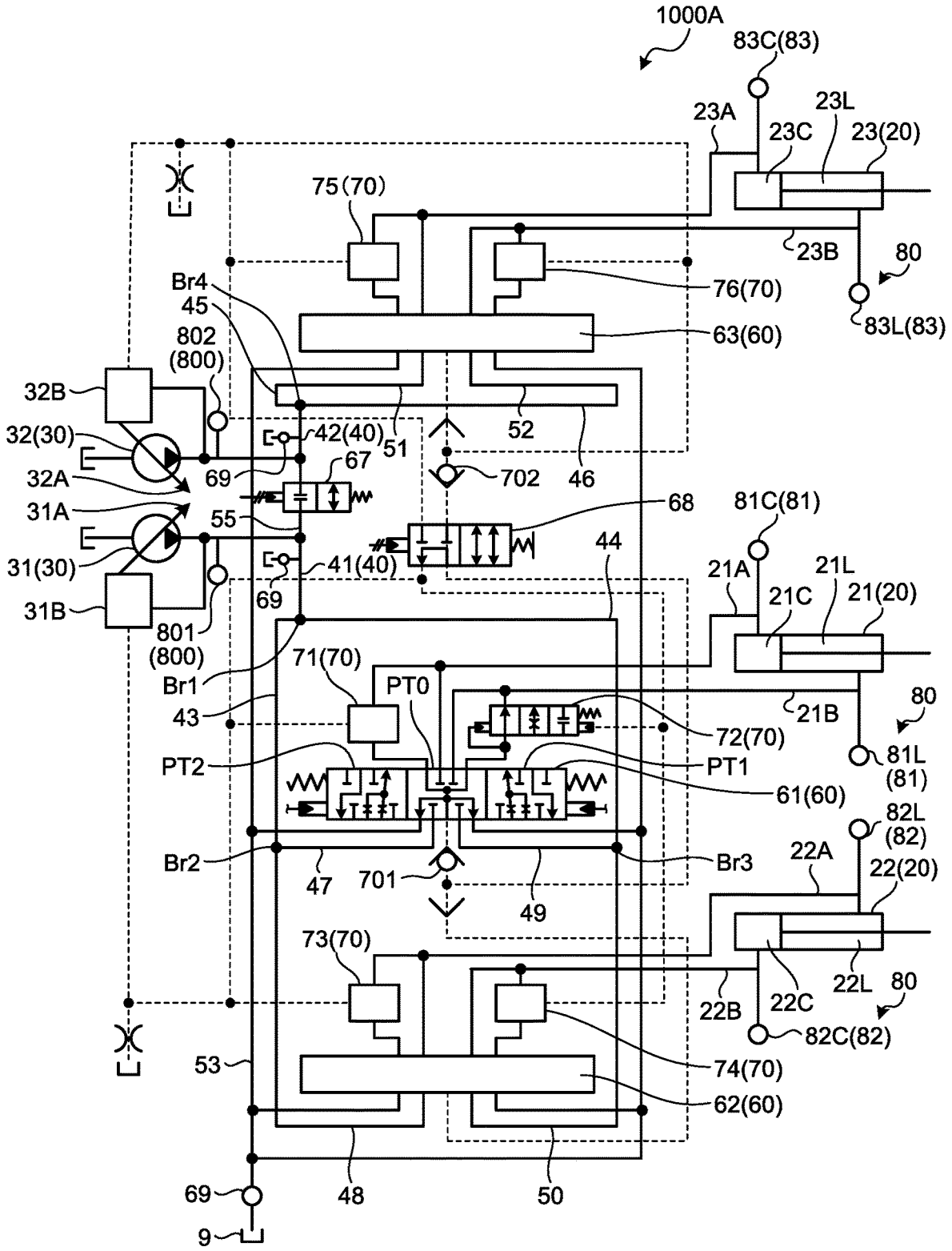
FIG. 4 is a diagram illustrating an exemplary hydraulic system according to the present embodiment.

FIG. 4 is a diagram illustrating an example of the hydraulic system 1000A according to the present embodiment.

The hydraulic system 1000A includes: the hydraulic pump 30 that discharges hydraulic fluid; the hydraulic circuit 40 where hydraulic fluid discharged from the hydraulic pump 30 flows; the hydraulic cylinder 20 to which the hydraulic fluid discharged from the hydraulic pump 30 is supplied via the hydraulic circuit 40; a main operation valve 60 that adjusts a direction of hydraulic fluid supplied to the hydraulic cylinder 20 and a distribution flow rate Qa of the hydraulic fluid; and a pressure compensating valve 70.

The hydraulic pump 30 includes the first hydraulic pump 31 and the second hydraulic pump 32. The hydraulic cylinder 20 includes the bucket cylinder 21, arm cylinder 22, and boom cylinder 23.

The main operation valve 60 includes: a first main operation valve 61 that adjusts a direction of hydraulic fluid supplied from the hydraulic pump 30 to the bucket cylinder 21 and a distribution flow rate Qabk of the hydraulic fluid; a second main operation valve 62 that adjusts a direction of hydraulic fluid supplied from the hydraulic pump 30 to the arm cylinder 22 and a distribution flow rate Qaar of the hydraulic fluid; and a third main operation valve 63 that adjusts a direction of hydraulic fluid supplied from the hydraulic pump 30 to the boom cylinder 23 and a distribution flow rate Qabm of the hydraulic fluid. The main operation valve 60 is a direction control valve of a slide spool system.

The pressure compensating valve 70 includes a pressure compensating valve 71, a pressure compensating valve 72, a pressure compensating valve 73, a pressure compensating valve 74, a pressure compensating valve 75, and a pressure compensating valve 76.

Additionally, the hydraulic system 1000A includes a first merging-separating valve 67 that is a switching device provided in a merging flow path 55 that connects the first hydraulic pump 31 to the second hydraulic pump 32, and capable of performing switching between a merged state in which the merging flow path 55 is opened and a separated state in which the merging flow path 55 is closed.

The hydraulic circuit 40 has: a first hydraulic pump flow path 41 connected to the first hydraulic pump 31; and a second hydraulic pump flow path 42 connected to the second hydraulic pump 32.

The hydraulic circuit 40 has: a first supply flow path 43 and a second supply flow path 44 which are connected to the first hydraulic pump flow path 41; and a third supply flow path 45 and a fourth supply flow path 46 which are connected to the second hydraulic pump flow path 42.

The first hydraulic pump flow path 41 is branched into the first supply flow path 43 and the second supply flow path 44 at a first branch portion Br1. The second hydraulic pump flow path 42 is branched into the third supply flow path 45 and the fourth supply flow path 46 at a fourth branch portion Br4.

The hydraulic circuit 40 has: a first branch flow path 47 and a second branch flow path 48 which are connected to the first supply flow path 43; and a third branch flow path 49 and a fourth branch flow path 50 which are connected to the second supply flow path 44. The first supply flow path 43 is branched into the first branch flow path 47 and the second branch flow path 48 at a second branch portion Br2. The second supply flow path 44 is branched into the third branch flow path 49 and the fourth branch flow path 50 at a third branch portion Br3.

The hydraulic circuit 40 has: a fifth branch flow path 51 connected to the third supply flow path 45; and a sixth branch flow path 52 connected to the fourth supply flow path 46.

The first main operation valve 61 is connected to the first branch flow path 47 and the third branch flow path 49. The second main operation valve 62 is connected to the second branch flow path 48 and the fourth branch flow path 50. The third main operation valve 63 is connected to the fifth branch flow path 51 and the sixth branch flow path 52.

The hydraulic circuit 40 has: a first bucket flow path 21A that connects the first main operation valve 61 to a cap-side space 210 of the bucket cylinder 21; and a second bucket flow path 21B that connects the first main operation valve 61 to a rod-side space 21L of the bucket cylinder 21.

The hydraulic circuit 40 has: a first arm flow path 22A that connects the second main operation valve 62 to a rod-side space 22L of the arm cylinder 22; and a second arm flow path 22B that connects the second main operation valve 62 to a cap-side space 22C of the arm cylinder 22.

The hydraulic circuit 40 has: a first boom flow path 23A that connects the third main operation valve 63 to a cap-side space 23C of the boom cylinder 23; and a second boom flow path 23B that connects the third main operation valve 63 to a rod-side space 23L of the boom cylinder 23.

The cap-side space of the hydraulic cylinder 20 is a space between a cylinder head cover and a piston. The rod-side space of the hydraulic cylinder 20 is a space in which a piston rod is arranged.

When hydraulic fluid is supplied to the cap-side space 21C of the bucket cylinder 21 and the bucket cylinder 21 is extended, the bucket 11 performs excavating operation.

When hydraulic fluid is supplied to the rod-side space 21L of the bucket cylinder 21 and the bucket cylinder 21 is retracted, the bucket 11 performs dumping operation.

When hydraulic fluid is supplied to the cap-side space 22C of the arm cylinder 22 and the arm cylinder 22 is extended, the arm 12 performs excavating operation. When hydraulic fluid is supplied to the rod-side space 22L of the arm cylinder 22 and the arm cylinder 22 is retracted, the arm 12 performs dumping operation.

When hydraulic fluid is supplied to the cap-side space 23C of the boom cylinder 23 and the boom cylinder 23 is extended, the boom 13 performs lifting operation. When hydraulic fluid is supplied to the rod-side space 23L of the boom cylinder 23 and the boom cylinder 23 is retracted, the boom 13 performs lowering operation.

The first main operation valve 61 supplies hydraulic fluid to the bucket cylinder 21 and recovers hydraulic fluid discharged from the bucket cylinder 21. A spool of the first main operation valve 61 is movable to: a stop position PTO whereby supply of hydraulic fluid to the bucket cylinder 21 is stopped to stop the bucket cylinder 21; a first position PT1 whereby the first branch flow path 47 and the first bucket flow path 21A are connected such that hydraulic fluid is supplied to the cap-side space 21C and the bucket cylinder 21 is extended; and a second position PT2 whereby the third branch flow path 49 and the second bucket flow path 21B are connected such that hydraulic fluid is supplied to the rod-side space 21L and the bucket cylinder 21 is retracted. The first main operation valve 61 is operated such that the bucket cylinder 21 becomes at least one of a stopped state, an extended state, and a retracted state.

The second main operation valve 62 supplies hydraulic fluid to the arm cylinder 22 and recovers hydraulic fluid discharged from the arm cylinder 22. The second main operation valve 62 has a structure similar to that of the first main operation valve 61. A spool of the second main operation valve 62 is movable to: a stop position whereby supply of hydraulic fluid to the arm cylinder 22 is stopped to stop the arm cylinder 22; a second position whereby the fourth branch flow path 50 and the second arm flow path 22B are connected such that hydraulic fluid is supplied to the cap-side space 22C and the arm cylinder 22 is extended; and a first position whereby the second branch flow path 48 and the first arm flow path 22A are connected such that hydraulic fluid is supplied to the rod-side space 22L and the arm cylinder 22 is retracted. The second main operation valve 62 is operated such that the arm cylinder 22 becomes at least one of a stopped state, an extended state, and a retracted state.

The third main operation valve 63 supplies hydraulic fluid to the boom cylinder 23 and recovers hydraulic fluid discharged from the boom cylinder 23. The third main operation valve 63 has a structure similar to that of the first main operation valve 61. A spool of the third main operation valve 63 is movable to: a stop position whereby supply of hydraulic fluid to the boom cylinder 23 is stopped to stop the boom cylinder 23; a first position whereby the fifth branch flow path 51 and the first boom flow path 23A are connected such that hydraulic fluid is supplied to the cap-side space 23C and the boom cylinder 23 is extended; and a second position whereby the sixth branch flow path 52 and the second boom flow path 23B are connected such that hydraulic fluid is supplied to the rod-side space 23L and the boom cylinder 23 is retracted. The third main operation valve 63 is operated such that the boom cylinder 23 becomes at least one of a stopped state, an extended state, and a retracted state.

The first main operation valve 61 is operated by the operation device 5. When the operation device 5 is operated, a pilot pressure determined on the basis of an operation amount of the operation device 5 acts on the first main operation valve 61. When the pilot pressure acts on the first main operation valve 61, a direction of hydraulic fluid supplied from the first main operation valve 61 to the bucket cylinder 21 and a distribution flow rate Qabk of the hydraulic fluid are determined. A rod of the bucket cylinder 21 is moved in a moving direction corresponding to the direction of the supplied hydraulic fluid, and actuated at a cylinder speed corresponding to the distribution flow rate Qabk of the supplied hydraulic fluid. When the bucket cylinder 21 is actuated, the bucket 11 is actuated on the basis of the moving direction and the cylinder speed of the bucket cylinder 21.

Similarly, the second main operation valve 62 is operated by the operation device 5. When the operation device 5 is operated, a pilot pressure determined on the basis of an operation amount of the operation device 5 acts on the second main operation valve 62. When the pilot pressure acts on the second main operation valve 62, a direction of hydraulic fluid supplied from the second main operation valve 62 to the arm cylinder 22 and a distribution flow rate Qaar of the hydraulic fluid are determined. A rod of the arm cylinder 22 is moved in a moving direction corresponding to the direction of the supplied hydraulic fluid, and actuated at a cylinder speed corresponding to the distribution flow rate Qaar of the supplied hydraulic fluid. When the arm cylinder 22 is actuated, the arm 12 is actuated on the basis of the moving direction and the cylinder speed of the arm cylinder 22.

Similarly, the third main operation valve 63 is operated by the operation device 5. When the operation device 5 is operated, a pilot pressure determined on the basis of an operation amount of the operation device 5 acts on the third main operation valve 63. When the pilot pressure acts on the third main operation valve 63, a direction of hydraulic fluid supplied from the third main operation valve 63 to the boom cylinder 23 and a distribution flow rate Qabm of the hydraulic fluid are determined. A rod of the boom cylinder 23 is moved in a moving direction corresponding to the direction of the supplied hydraulic fluid, and actuated at a cylinder speed corresponding to the distribution flow rate Qabm of the supplied hydraulic fluid. When the boom cylinder 23 is actuated, the boom 13 is actuated on the basis of the moving direction and the cylinder speed of the boom cylinder 23.

The hydraulic fluid discharged from each of the bucket cylinder 21, arm cylinder 22, and boom cylinder 23 is recovered in a hydraulic fluid tank 9 via a discharge flow path 53.

The first hydraulic pump flow path 41 and the second hydraulic pump flow path 42 are connected by the merging flow path 55. The merging flow path 55 is a flow path that connects the first hydraulic pump 31 to the second hydraulic pump 32. The merging flow path 55 connects the first hydraulic pump 31 to the second hydraulic pump 32 via the first hydraulic pump flow path 41 and the second hydraulic pump flow path 42.

The first merging-separating valve 67 is a switching device to open and close the merging flow path 55. The first merging-separating valve 67 performs switching between a merged state in which the merging flow path 55 is opened and a separated state in which the merging flow path 55 is closed by opening and closing the merging flow path 55. In the present embodiment, the first merging-separating valve 67 is a switching valve. Note that as far as the merging flow path 55 can be opened and closed, the switching device that opens and closes the merging flow path 55 may not necessarily be the switching valve.

A spool of the first merging-separating valve 67 is movable to: a merging position whereby the first hydraulic pump flow path 41 and the second hydraulic pump flow path 42 are connected by opening the merging flow path 55; and a separating position whereby the first hydraulic pump flow path 41 and the second hydraulic pump flow path 42 are separated by closing the merging flow path 55. The control device 100 controls the first merging-separating valve 67 such that the first hydraulic pump flow path 41 and the second hydraulic pump flow path 42 to become any one of the merged state and the separated state.

The merged state represents a state in which: the first hydraulic pump flow path 41 and the second hydraulic pump flow path 42 are connected via the merging flow path 55 when the merging flow path 55 that connects the first hydraulic pump flow path 41 to the second hydraulic pump flow path 42 is opened by the first merging-separating valve 67; and hydraulic fluid discharged from the first hydraulic pump flow path 41 and hydraulic fluid discharged from the second hydraulic pump flow path 42 are merged at the first merging-separating valve 67. In the merged state, the hydraulic fluid discharged from both of the first hydraulic pump 31 and the second hydraulic pump 32 is supplied to each of the bucket cylinder 21, the arm cylinder 22, and the boom cylinder 23.

The separated state represents a state in which: the first hydraulic pump flow path 41 and the second hydraulic pump flow path 42 are separated from each other when the merging flow path 55 that connects the first hydraulic pump flow path 41 to the second hydraulic pump flow path 42 is closed by the first merging-separating valve 67; and the hydraulic fluid discharged from the first hydraulic pump flow path 41 and the hydraulic fluid discharged from the second hydraulic pump flow path 42 are separated. In the separated state, the hydraulic fluid discharged from the first hydraulic pump 31 is supplied to the bucket cylinder 21 and the arm cylinder 22, and the hydraulic fluid discharged from the second hydraulic pump 32 is supplied to the boom cylinder 23.

In other words, in the present embodiment, the first hydraulic actuator to which the hydraulic fluid discharged from the first hydraulic pump 31 is supplied in the separated state corresponds to the bucket cylinder 21 that drives the bucket 11 and the arm cylinder 22 that drives the arm 12. The second hydraulic actuator to which the hydraulic fluid discharged from the second hydraulic pump 32 is supplied in the separated state corresponds to the boom cylinder 23 that drives the boom 13. In the separated state, the hydraulic fluid discharged from the first hydraulic pump 31 is not supplied to the boom cylinder 23. In the separated state, the hydraulic fluid discharged from the second hydraulic pump 32 is not supplied to the bucket cylinder 21 and the arm cylinder 22.

In the merged state, the hydraulic fluid discharged from each of the first hydraulic pump 31 and the second hydraulic pump 32 passes through each of the first hydraulic pump flow path 41, second hydraulic pump flow path 42, first main operation valve 61, second main operation valve 62, and third main operation valve 63 and then is supplied to each of the bucket cylinder 21, arm cylinder 22, and boom cylinder 23.

In the separated state, the hydraulic fluid discharged from the first hydraulic pump 31 passes through the first hydraulic pump flow path 41, first main operation valve 61, and second main operation valve 62 and then is supplied to the bucket cylinder 21 and arm cylinder 22. Additionally, in the separated state, the hydraulic fluid discharged from the second hydraulic pump 32 passes through the second hydraulic pump flow path 42 and the third main operation valve 63 and then is supplied to the boom cylinder 23.

The hydraulic system 1000A has: a shuttle valve 701 provided between the first main operation valve 61 and the second main operation valve 62; and a shuttle valve 702 provided between a second merging-separating valve 68 and the third main operation valve 63. Additionally, the hydraulic system 1000A has the second merging-separating valve 68 connected to the shuttle valve 701 and the shuttle valve 702.

The second merging-separating valve 68 selects a maximum pressure of a load sensing pressure (LS pressure) obtained by depressurizing the hydraulic fluid supplied to each of the bucket cylinder 21, arm cylinder 22, and boom cylinder 23 by the shuttle valve 701 and the shuttle valve 702. The load sensing pressure is a pilot pressure used for pressure compensation.

When the second merging-separating valve 68 is in the merged state, the maximum LS pressure among pressures in the bucket cylinder 21 to the boom cylinder 23 is selected and supplied to the pressure compensating valve 70 in each of the bucket cylinder 21 to the boom cylinder 23 and also supplied to the servo mechanism 31B of the first hydraulic pump 31 and the servo mechanism 32B of the second hydraulic pump 32.

When the second merging-separating valve 68 is in the separated state, the maximum LS pressure in each of the bucket cylinder 21 and the arm cylinder 22 is supplied to the pressure compensating valve 70 in each of the bucket cylinder 21 and the arm cylinder 22 and the servo mechanism 31B of the first hydraulic pump 31, and the LS pressure of the boom cylinder 23 is supplied to the pressure compensating valve 70 of the boom cylinder 23 and the servo mechanism 32B of the second hydraulic pump 32.

The shuttle valve 701 and the shuttle valve 702 select a pilot pressure indicating a maximum value from among pilot pressures output from the first main operation valve 61, second main operation valve 62, and third main operation valve 63. The selected pilot pressure is supplied to the pressure compensating valve 70 and the servo mechanism (31B, 32B) of the hydraulic pump 30 (31, 32).

<Pressure Sensor>

The hydraulic system 1000A has a load pressure sensor 80 that detects a pressure PL of hydraulic fluid in the hydraulic cylinder 20. The pressure PL of the hydraulic fluid in the hydraulic cylinder 20 is a load pressure of hydraulic fluid supplied to the hydraulic cylinder 20. A detection signal of the load pressure sensor 80 is output to the control device 100.

In the present embodiment, the load pressure sensor 80 includes: a bucket load pressure sensor 81 that detects a pressure PLbk of hydraulic fluid in the bucket cylinder 21, an arm load pressure sensor 82 that detects a pressure PLar of hydraulic fluid in the arm cylinder 22, and a boom load pressure sensor 83 that detects a pressure PLbm of the hydraulic fluid in the boom cylinder 23.

The bucket load pressure sensor 81 includes: a bucket load pressure sensor 81C provided in the first bucket flow path 21A and detecting a pressure PLbkc of hydraulic fluid in the cap-side space 21C of the bucket cylinder 21; and a bucket load pressure sensor 81L provided in the second bucket flow path 21B and detecting a pressure PLbkl of hydraulic fluid in the rod-side space 21L of the bucket cylinder 21.

The arm load pressure sensor 82 includes: an arm load pressure sensor 82C provided in the second arm flow path 22B and detecting a pressure PLarc of hydraulic fluid in the cap-side space 22C of the arm cylinder 22; and an arm load pressure sensor 82L provided in the first arm flow path 22A and detecting a pressure PLarl of hydraulic fluid in the rod-side space 22L of the arm cylinder 22.

The boom load pressure sensor 83 includes: a boom load pressure sensor 83C provided in the first boom flow path 23A and detecting a pressure PLbmc of hydraulic fluid in the cap-side space 23C of the boom cylinder 23; and a boom load pressure sensor 83L provided in the second boom flow path 23B and detecting a pressure PLbml of hydraulic fluid in the rod-side space 23L of the boom cylinder 23.

Furthermore, the hydraulic system 1000A has a discharge pressure sensor 800 that detects a discharge pressure P of hydraulic fluid discharged from the hydraulic pump 30. A detection signal of the discharge pressure sensor 800 is output to the control device 100.

The discharge pressure sensor 800 includes: a discharge pressure sensor 801 provided between the first hydraulic pump 31 and the first hydraulic pump flow path 41 and detecting a discharge pressure P1 of hydraulic fluid discharged from the first hydraulic pump 31; and a discharge pressure sensor 802 provided between the second hydraulic pump 32 and the second hydraulic pump flow path 42 and detecting a discharge pressure P2 of hydraulic fluid discharged from the second hydraulic pump 32.

<Pressure Compensating Valve>

The pressure compensating valve 70 has a selection port to make a selection from among communicating, throttling, and blocking. The pressure compensating valve 70 includes a throttle valve that enables switching between blocking, throttling, and communicating by self-pressure. The pressure compensating valve 70 is directed to compensating flow rate distribution in accordance with a ratio of a metering opening area of each main operation valve 60 even when a load pressure of each hydraulic cylinder 20 is different. In the case of having no pressure compensating valve 70, most of hydraulic fluid flows into the hydraulic cylinder 20 on a low load side. The pressure compensating valve 70 implements a function of flow rate distribution because an outlet pressure of each main operation valve 60 is made uniform by making a pressure loss act on the hydraulic cylinder 20 having a low load pressure such that an outlet pressure of the main operation valve 60 of the hydraulic cylinder 20 having the low load pressure becomes equivalent to an outlet pressure of the main operation valve 60 of the hydraulic cylinder 20 having a maximum load pressure.

The pressure compensating valve 70 includes a pressure compensating valve 71 and a pressure compensating valve 72 which are connected to the first main operation valve 61, a pressure compensating valve 73 and a pressure compensating valve 74 which are connected to the second main operation valve 62, a pressure compensating valve 75 and a pressure compensating valve 76 which are connected to the third main operation valve 63.

The pressure compensating valve 71 compensates a differential pressure (metering differential pressure) between before and after the first main operation valve 61 in a state in which the first branch flow path 47 and the first bucket flow path 21A are connected such that hydraulic fluid is supplied to the cap-side space 21C. The pressure compensating valve 72 compensates a differential pressure (metering differential pressure) between before and after the first main operation valve 61 in a state in which the third branch flow path 49 and the second bucket flow path 21B are connected such that hydraulic fluid is supplied to the rod-side space 21L.

The pressure compensating valve 73 compensates a differential pressure (metering differential pressure) between before and after the second main operation valve 62 in a state in which the second branch flow path 48 and the first arm flow path 22A are connected such that hydraulic fluid is supplied to the rod-side space 22L. The pressure compensating valve 74 compensates a differential pressure (metering differential pressure) between before and after the second main operation valve 62 in a state in which the fourth branch flow path 50 and the second arm flow path 22B are connected such that hydraulic fluid is supplied to the cap-side space 22C.

Meanwhile, the differential pressure (metering differential pressure) between before and after the main operation valve 60 represents a difference between a pressure at an inlet port corresponding to the hydraulic pump 30 side of the main operation valve 60 and a pressure at an outlet port corresponding to the hydraulic cylinder 20 side, and corresponds to a differential pressure to measure a flow rate (metering).

Using the pressure compensating valve 70, hydraulic fluid can be distributed to each of the bucket cylinder 21 and the arm cylinder 22 at a flow rate according to an operation amount of the operation device 5 even in the case where a light load acts on the hydraulic cylinder 20 corresponding to one of the bucket cylinder 21 and the arm cylinder 22 and a heavy load acts on the hydraulic cylinder 20 corresponding to the other thereof.

The pressure compensating valve 70 enables supply at a flow rate based on operation regardless of loads acting on the plurality of hydraulic cylinders 20. For example, in the case where a heavy load acts on the bucket cylinder 21 while a light load acts on the arm cylinder 22, the pressure compensating valve 70 (73, 74) arranged on the light load side compensates a metering differential pressure ΔP2 on the arm cylinder 22 side, namely, the light load side so as to become a pressure substantially equal to a metering differential pressure ΔP1 on the bucket cylinder 21 side such that supply is performed at a flow rate based on an operation amount of the second main operation valve 62 when hydraulic fluid is supplied from the second main operation valve 62 to the arm cylinder 22, regardless of the metering differential pressure ΔP1 generated by hydraulic fluid is supplied from the first main operation valve 61 to the bucket cylinder 21.

In the case where a heavy load acts on the arm cylinder 22 while a light load acts on the bucket cylinder 21, the pressure compensating valve 70 (71, 72) arranged on the light load side compensates the metering differential pressure ΔP1 on the light load side such that supply is performed at a flow rate based on an operation amount of the first main operation valve 61 when hydraulic fluid is supplied from the first main operation valve 61 to the bucket cylinder 21, regardless of the metering differential pressure ΔP2 generated by hydraulic fluid being supplied from the second main operation valve 62 to the arm cylinder 22.

<Unload Valve>

The hydraulic circuit 40 has an unloading valve 69. In the hydraulic circuit 40, even when the hydraulic cylinder 20 is not driven, hydraulic fluid at a flow rate corresponding to a minimum capacity is discharged from the hydraulic pump 30. When the hydraulic cylinder 20 is not driven, the hydraulic fluid discharged from the hydraulic pump 30 is discharged (unloaded) via the unloading valve 69.

[Control Device]

Figure 5:
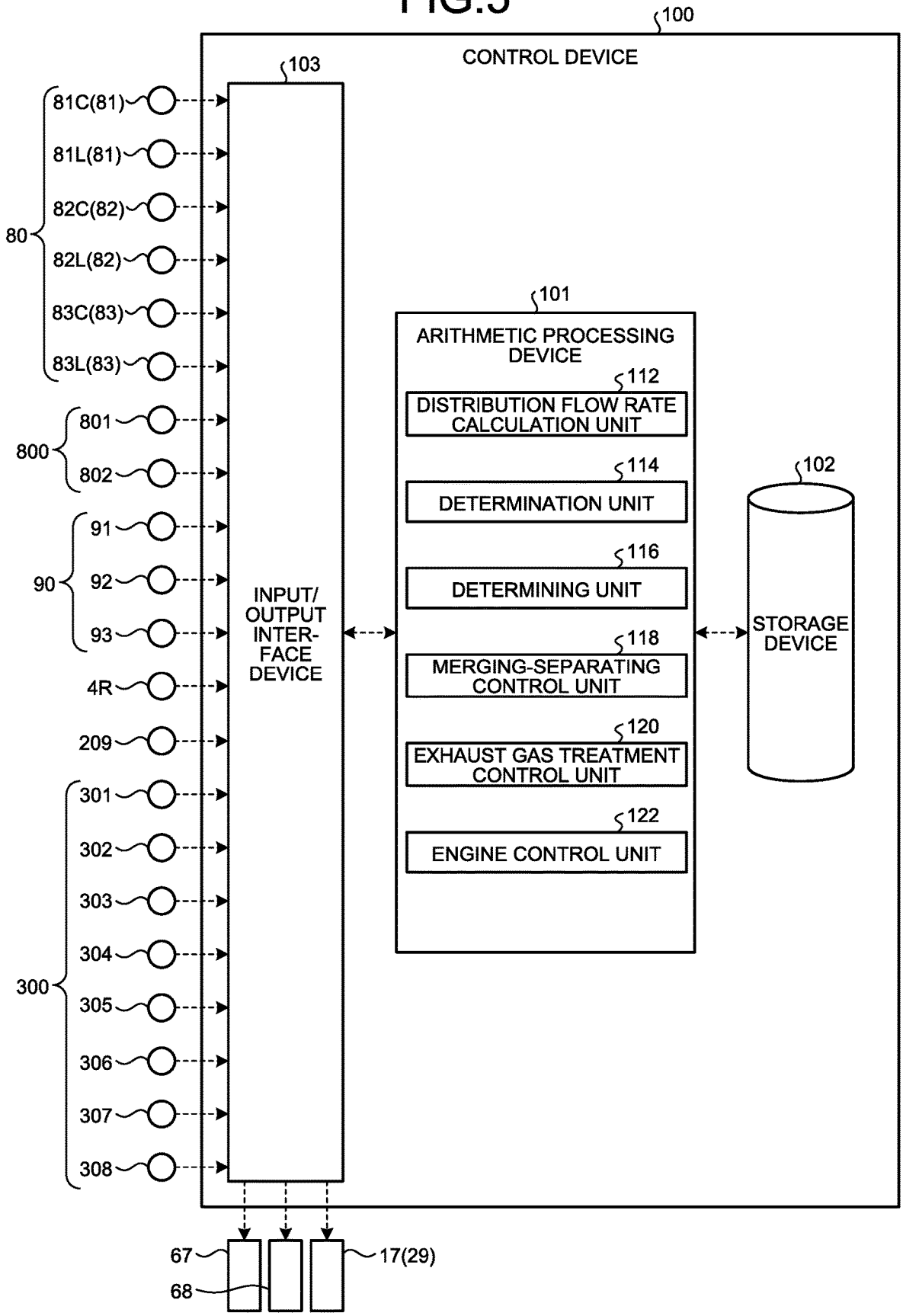
FIG. 5 is a functional block diagram illustrating an exemplary control device according to the present embodiment.

FIG. 5 is a functional block diagram illustrating an exemplary control device 100 according to the present embodiment. The control device 100 includes a computer system. The control device 100 has an arithmetic processing device 101, a storage device 102, and an input/output interface device 103.

The control device 100 is connected to the first merging-separating valve 67 and the second merging-separating valve 68, and outputs command signals to the first merging-separating valve 67 and the second merging-separating valve 68.

Furthermore, the control device 100 is connected to the fuel injection device 17 (common rail control unit 29) and outputs a command signal to the fuel injection device 17.

Additionally, the control device 100 is connected to each of the load pressure sensor 80 that detects a pressure PL of the hydraulic cylinder 20, the discharge pressure sensor 800 that detects a discharge pressure P of hydraulic fluid discharged from the hydraulic pump 30, the operation amount sensor 90 that detects an operation amount S of the operation device 5, the engine speed sensor 4R, the reducing agent sensor 209, and the exhaust gas sensor 300.

In the present embodiment, the operation amount sensor 90 (91, 92, 93) is a pressure sensor. When the operation device 5 is operated in order to drive the bucket cylinder 21, a pilot pressure acting on the first main operation valve 61 is changed on the basis of an operation amount Sbk of the operation device 5. Furthermore, when the operation device 5 is operated in order to drive the arm cylinder 22, a pilot pressure acting on the second main operation valve 62 is changed on the basis of an operation amount Sar of the operation device 5. Additionally, when the operation device 5 is operated in order to drive the boom cylinder 23, a pilot pressure acting on the third main operation valve 63 is changed on the basis of an operation amount Sbm of the operation device 5. The bucket operation amount sensor 91 detects the pilot pressure acting on the first main operation valve 61 when the operation device 5 is operated in order to drive the bucket cylinder 21. The arm operation amount sensor 92 detects the pilot pressure acting on the second main operation valve 62 when the operation device 5 is operated in order to drive the arm cylinder 22. The boom operation amount sensor 93 detects the pilot pressure acting on the third main operation valve 63 when the operation device 5 is operated in order to drive the boom cylinder 23.

The arithmetic processing device 101 includes a distribution flow rate calculation unit 112, a determination unit 114, a determining unit 116, a merging-separating control unit 118, an exhaust gas treatment control unit 120, and an engine control unit 122.

<Distribution Flow Rate Calculation Unit>

The distribution flow rate calculation unit 112 calculates a distribution flow rate Qa of hydraulic fluid supplied to each of the plurality of hydraulic cylinders 20 on the basis of a pressure PL of hydraulic fluid in each of the plurality of hydraulic cylinders 20 and an operation amount S of the operation device 5 operated in order to drive each of the plurality of hydraulic cylinders 20. In the present embodiment, the distribution flow rate calculation unit 112 calculates the distribution flow rate Qa on the basis of the pressure PL of hydraulic fluid in the hydraulic cylinder 20, the operation amount S of the operation device 5, and the discharge pressure P of hydraulic fluid discharged from the hydraulic pump 30.

The pressure PL of the hydraulic fluid of the hydraulic cylinder 20 is detected by the load pressure sensor 80. The distribution flow rate calculation unit 112 acquires the pressure PLbk of the hydraulic fluid in the bucket cylinder 21 from the bucket load pressure sensor 81, acquires the pressure PLar of the hydraulic fluid in the arm cylinder 22 from the arm load pressure sensor 82, and acquires the pressure PLbm of the hydraulic fluid in the boom cylinder 23 from the boom load pressure sensor 83.

The operation amount S of the operation device 5 is detected by the operation amount sensor 90. The distribution flow rate calculation unit 112 acquires the operation amount Sbk of the operation device 5 operated in order to drive the bucket cylinder 21 from the bucket operation amount sensor 91, acquires the operation amount Sar of the operation device 5 operated in order to drive the arm cylinder 22 from the arm operation amount sensor 92, and acquires the operation amount Sbm of the operation device 5 operated in order to drive the boom cylinder 23 from the boom operation amount sensor 93.

The discharge pressure P of the hydraulic fluid in the hydraulic pump 30 is detected by the discharge pressure sensor 800. The distribution flow rate calculation unit 112 acquires the discharge pressure P1 of the hydraulic fluid in the first hydraulic pump 31 from the discharge pressure sensor 801, and acquires the discharge pressure P2 of the hydraulic fluid in the second hydraulic pump 32 from the discharge pressure sensor 802.

The distribution flow rate calculation unit 112 calculates the distribution flow rate Qa (Qabk, Qaar, Qabm) of hydraulic fluid supplied to each of the plurality of hydraulic cylinder 20 (21, 22, 23) on the basis of the pressure PL (PLbk, PLar, PLbm) of the hydraulic fluid in each of the plurality of hydraulic cylinders 20 (21, 22, 23) and the operation amount S (Sbk, Sar, Sbm) of the operation device 5 operated in order to drive each of the plurality of hydraulic cylinders 20 (21, 22, 23).

The distribution flow rate calculation unit 112 calculates the distribution flow rate Qa on the basis of Expression (1).

$$Qa=Qd\times\sqrt{\{(P-PL)/\Delta PC\}} \quad (1)$$

In Expression (1), Qd represents a required flow rate of the hydraulic fluid in the hydraulic cylinder 20. P represents a discharge pressure of the hydraulic fluid discharged from the hydraulic pump 30. PL represents a load pressure of the hydraulic fluid in the hydraulic cylinder 20. ΔPC represents a setting differential pressure between an inlet side and an outlet side of the main operation valve 60. In the present embodiment, the differential pressure between the inlet side and the outlet side of the main operation valve 60 is set as the setting differential pressure ΔPC. The setting differential pressure ΔPC is preset for each of the first main operation valve 61, second main operation valve 62, and third main operation valve 63, and stored in the storage device 102.

The distribution flow rate Qabk of the bucket cylinder 21, the distribution flow rate Qaar of the arm cylinder 22, and the distribution flow rate Qabm of the boom cylinder 23 are respectively calculated on the basis of Expressions (2), (3), and (4).

$$Qabk=Qdbk\times\sqrt{\{(P-PLbk)/\Delta PC\}} \quad (2)$$

$$Qaar=Qdar\times\sqrt{\{(P-PLar)/\Delta PC\}} \quad (3)$$

$$Qabm=Qdbm\times\sqrt{\{(P-PLbm)/\Delta PC\}} \quad (4)$$

In Expression (2), Qdbk represents a required flow rate of the hydraulic fluid in the bucket cylinder 21. PLbk represents a pressure of the hydraulic fluid in the bucket cylinder 21. In Expression (3), Qdar represents a required flow rate of the hydraulic fluid in the arm cylinder 22. PLar represents a pressure of the hydraulic fluid in the arm cylinder 22. In Expression (4), Qdbm represents a required flow rate of the hydraulic fluid in the boom cylinder 23. PLbm is a load pressure of the hydraulic fluid in the boom cylinder 23. In the present embodiment, a setting differential pressure ΔPC between an inlet side and an outlet side of the first main operation valve 61, a setting differential pressure ΔPC between an inlet side and an outlet side of the second main operation valve 62, and a setting differential pressure ΔPC between an inlet side and an outlet side of the third main operation valve 63 are the same values.

The required flow rate Qd (Qdbk, Qdar, Qdbm) is calculated on the basis of the operation amount S (Sbk, Sar, Sbm) of the operation device 5. In the present embodiment, the required flow rate Qd (Qdbk, Qdar, Qdbm) is calculated on the basis of a pilot pressure detected by the operation amount sensor 90 (91, 92, 93). The operation amount S (Sbk, Sar, Sbm) of the operation device 5 corresponds one-to-one with the pilot pressure detected by the operation amount sensor 90 (91, 92, 93). The distribution flow rate calculation unit 112 converts the pilot pressure detected by the operation amount sensor 90 into a spool stroke of the main operation valve 60, and calculates the required flow rate Qd on the basis of the spool stroke. The first correlation data indicating a relation between the pilot pressure and the spool stroke of the main operation valve 60 and the second correlation data indicating a relation between the spool stroke of the main operation valve 60 and the required flow rate Qd are known data and stored in the storage device 102, respectively. The first correlation data indicating the relation between the pilot pressure and the spool stroke of the main operation valve 60 and the second correlation data indicating the relation between the spool stroke of the main operation valve 60 and the required flow rate Qd each include conversion table data.

The distribution flow rate calculation unit 112 acquires a detection signal of the bucket operation amount sensor 91 that has detected the pilot pressure acting on the first main operation valve 61. The distribution flow rate calculation unit 112 converts the pilot pressure acting on the first main operation valve 61 into a spool stroke of the first main operation valve 61 by using the first correlation data stored in the storage device 102. Consequently, the spool stroke of the first main operation valve 61 is calculated on the basis of the detection signal of the bucket operation amount sensor 91 and the first correlation data stored in the storage device 102. Furthermore, the distribution flow rate calculation unit 112 converts the calculated spool stroke of the first main operation valve 61 into a required flow rate Qdbk of the bucket cylinder 21 by using the second correlation data stored in the storage device 102. Consequently, the distribution flow rate calculation unit 112 can calculate the required flow rate Qdbk of the bucket cylinder 21.

The distribution flow rate calculation unit 112 acquires a detection signal of the arm operation amount sensor 92 that has detected the pilot pressure acting on the second main operation valve 62. The distribution flow rate calculation unit 112 converts the pilot pressure acting on the second main operation valve 62 into a spool stroke of the second main operation valve 62 by using the first correlation data stored in the storage device 102. Consequently, the spool stroke of the second main operation valve 62 is calculated on the basis of the detection signal of the arm operation amount sensor 92 and the first correlation data stored in the storage device 102. Furthermore, the distribution flow rate calculation unit 112 converts the calculated spool stroke of the second main operation valve 62 into a required flow rate Qdar of the arm cylinder 22 by using the second correlation data stored in the storage device 102. Consequently, the distribution flow rate calculation unit 112 can calculate the required flow rate Qdar of the arm cylinder 22.

The distribution flow rate calculation unit 112 acquires a detection signal of the boom operation amount sensor 93 that has detected the pilot pressure acting on the third main operation valve 63. The distribution flow rate calculation unit 112 converts the pilot pressure acting on the third main operation valve 63 into a spool stroke of the third main operation valve 63 by using the first correlation data stored in the storage device 102. Consequently, the spool stroke of the third main operation valve 63 is calculated on the basis of the detection signal of the boom operation amount sensor 93 and the first correlation data stored in the storage device 102. Furthermore, the distribution flow rate calculation unit 112 converts the calculated spool stroke of the third main operation valve 63 into a required flow rate Qdbm of the boom cylinder 23 by using the second correlation data stored in the storage device 102. Consequently, the distribution flow rate calculation unit 112 can calculate the required flow rate Qdbm of the boom cylinder 23.

Meanwhile, as described above, the bucket load pressure sensor 81 includes the bucket load pressure sensor 81C and the bucket load pressure sensor 81L, and the pressure PLbk of the hydraulic fluid in the bucket cylinder 21 includes the pressure PLbkc of the hydraulic fluid in the cap-side space 21C of the bucket cylinder 21 and the pressure PLbkl of the hydraulic fluid in the rod-side space 21L of the bucket cylinder 21. In the case of calculating the distribution flow rate Qabk by using Expression (2), the distribution flow rate calculation unit 112 selects any one of the pressure PLbkc and the pressure PLbkl on the basis of a moving direction of the spool of the first main operation valve 61. For example, in the case where the spool of the first main operation valve 61 is moved in a first direction, the distribution flow rate calculation unit 112 calculates, on the basis of Expression (2), the distribution flow rate Qabk by using the pressure PLbkc detected by the bucket load pressure sensor 81C. In the case where the spool of the first main operation valve 61 is moved in a second direction that is an opposite direction of the first direction, the distribution flow rate calculation unit 112 calculates, on the basis of Expression (2), the distribution flow rate Qabk by using the pressure PLbkl detected by the bucket load pressure sensor 81L.

Similarly, the arm load pressure sensor 82 includes the arm load pressure sensor 82C and the arm load pressure sensor 82L, and the pressure PLar of hydraulic fluid in the arm cylinder 22 includes the pressure PLarc of the hydraulic fluid in the cap-side space 22C of the arm cylinder 22 and the pressure PLarl of the hydraulic fluid in the rod-side space 22L of the arm cylinder 22. In the case of calculating the distribution flow rate Qaar by using Expression (3), the distribution flow rate calculation unit 112 selects any one of the pressure PLarc and the pressure PLarl on the basis of a moving direction of the spool of the second main operation valve 62. For example, in the case where the spool of the second main operation valve 62 is moved in a first direction, the distribution flow rate calculation unit 112 calculates, on the basis of Expression (3), the distribution flow rate Qaar by using the pressure PLarc detected by the arm load pressure sensor 82C. In the case where the spool of the second main operation valve 62 is moved in a second direction that is an opposite direction of the first direction, the distribution flow rate calculation unit 112 calculates, on the basis of Expression (3), the distribution flow rate Qaar by using the pressure PLarl detected by the arm load pressure sensor 82L.

Similarly, the boom load pressure sensor 83 includes the boom load pressure sensor 83C and the boom load pressure sensor 83L, and the pressure PLbm of hydraulic fluid in the boom cylinder 23 includes the pressure PLbmc of the hydraulic fluid in the cap-side space 23C of the boom cylinder 23 and the pressure PLbml of the hydraulic fluid in the rod-side space 23L of the boom cylinder 23. In the case of calculating the distribution flow rate Qabm by using Expression (4), the distribution flow rate calculation unit 112 selects any one of the pressure PLbmc and the pressure PLbml on the basis of a moving direction of the spool of the third main operation valve 63. For example, in the case where the spool of the third main operation valve 63 is moved in a first direction, the distribution flow rate calculation unit 112 calculates, on the basis of Expression (4), the distribution flow rate Qabm by using the pressure PLbmc detected by the boom load pressure sensor 83C. In the case where the spool of the third main operation valve 63 is moved in a second direction that is an opposite direction of the first direction, the distribution flow rate calculation unit 112 calculates, on the basis of Expression (4), the distribution flow rate Qabm by using the pressure PLbml detected by the boom load pressure sensor 83L.

In the present embodiment, the discharge pressure P of the hydraulic fluid discharged from the hydraulic pump 30 is detected by the discharge pressure sensor 800. Meanwhile, when the discharge pressure P of the hydraulic fluid discharged from the hydraulic pump 30 is unknown in Expressions (1) to (4), the distribution flow rate calculation unit 112 may calculate the distribution flow rates Qabk, Qaar, and Qabm by repeating numerical calculation such that Expression (5) become convergent.

$$Qlp=Qabk+Qaar+Qabm \quad (5)$$

In Expression (5), Qlp represents a pump limit flow rate. The pump limit flow rate Qlp is set to a minimum value among the maximum discharge flow rate Qmax of the hydraulic pump 30, a target discharge flow rate Qt1 of the first hydraulic pump 31 determined on the basis of target output of the first hydraulic pump 31, and a target discharge flow rate Qt2 of the second hydraulic pump 32 determined on the basis of target output of the second hydraulic pump 32.

Meanwhile, in the present embodiment, the operation device 5 includes an operating lever of a pilot pressure system, and a pressure sensor is used as the operation amount sensor 90 (91, 92, 93). The operation device 5 may also include an operating lever of an electric system. In the case where the operation device 5 includes the operating lever of the electric system, a stroke sensor that can detect a lever stroke indicating a stroke of the operating lever is used as the operation amount sensor (91, 92, 93). The distribution flow rate calculation unit 112 converts a lever stroke detected by the operation amount sensor 90 into a spool stroke of the main operation valve 60, and can calculate the required flow rate Qd on the basis of the spool stroke. The distribution flow rate calculation unit 112 can convert the lever stroke into the spool stroke by using a predetermined conversion table.

<Determination Unit>

The determination unit 114 determines to perform switching to the merged state or switching to the separated state on the basis of the distribution flow rate Qa calculated in the distribution flow rate calculation unit 201. In the present embodiment, the determination unit 114 determines to perform switching to the merged state or switching the separated state on the basis of a comparison result between the distribution flow rate Qa calculated in the distribution flow rate calculation unit 112 and a threshold value Qs.

The threshold value Qs is a threshold value for the distribution flow rate Qa of the hydraulic cylinder 20. When the distribution flow rate Qa calculated in the distribution flow rate calculation unit 112 is the threshold value Qs or less, the determination unit 114 determines to perform switching to the separated state. When the distribution flow rate Qa calculated in the distribution flow rate calculation unit 112 is larger than the threshold value Qs, the determination unit 112 determines to perform switching to the merged state.

In the present embodiment, the threshold value Qs is the maximum discharge flow rate Qmax of the hydraulic fluid that can be discharged by each of the first hydraulic pump 31 and the second hydraulic pump 32. In other words, in the present embodiment, the determination unit 114 determines to perform switching to the merged state or switching the separated state on the basis of a comparison result between the distribution flow rate Qa and the maximum discharge flow rate Qmax. When the distribution flow rate Qa is the most discharge flow rate Qmax or less, the determination unit 114 determines to perform switching to the separated state. When the distribution flow rate Qa is larger than the maximum discharge flow rate Qmax, the determination unit 114 determines to perform switching to the merged state.

In the present embodiment, when the sum of the distribution flow rate Qabk of the hydraulic fluid supplied to the bucket cylinder 21 and the distribution flow rate Qaar of the hydraulic fluid supplied to the arm cylinder 22 is equal to or less than the maximum discharge flow rate Q1max of the first hydraulic pump 31 and also when the distribution flow rate Qabm of the hydraulic fluid supplied to the boom cylinder 23 is equal to or less than the maximum discharge flow rate Q2max of the second hydraulic pump 32, the determination unit 114 determines to perform switching to the separated state. When the sum of the distribution flow rate Qabk of the hydraulic fluid supplied to the bucket cylinder 21 and the distribution flow rate Qaar of the hydraulic fluid supplied to the arm cylinder 22 is larger than the maximum discharge flow rate Q1max of the first hydraulic pump 31 or when the distribution flow rate Qabm of the hydraulic fluid supplied to the boom cylinder 23 is larger than the maximum discharge flow rate Q2max of the second hydraulic pump 32, the determination unit 114 determines to perform switching to the merged state.

In the following description, a state in which following conditions are satisfied will be referred to as satisfying separating conditions: the distribution flow rate Qa calculated in the distribution flow rate calculation unit 112 is the threshold value Qs or less; and the determination unit 114 can determine to perform switching to the separated state.

<Determining Unit>

The determining unit 116 determines whether output of the engine 4 is limited. When it is determined that the exhaust gas treatment device 200 is in an abnormal state, the determining unit 116 determines that the output of the engine 4 is limited. Furthermore, when it is determined that the exhaust gas sensor 300 is in an abnormal state, the determining unit 116 determines that the output of the engine 4 is limited. The determining unit 116 determines that the output of the engine 4 is limited when the engine 4 cannot be protected, for example, when it is determined that at least one of the outside air temperature sensor 307 and the coolant temperature sensor 308 which constitute the part of the exhaust gas sensor 300, and an engine hydraulic sensor not illustrated is in an abnormal state.

The state in which the exhaust gas treatment device 200 is in an abnormal state means the state of occurrence of an event in which treatment performance (purification performance) for the exhaust gas by the exhaust gas treatment device 200 is degraded or may be degraded. For example, in occurrence of an event in which an amount of the reducing agent R stored in the reducing agent tank 205 is decreased to a value less than an allowable value due to consumption, leakage, or the like, the treatment performance (purification performance) for the exhaust gas by the exhaust gas treatment device 200 is degraded or may be degraded. The amount of the reducing agent R stored in the reducing agent tank 205 is detected by the reducing agent sensor 209. The determining unit 116 determines that output of the engine 4 is limited when it is determined that the amount of the reducing agent R stored in the reducing agent tank 205 is decreased to an amount less than the allowable value on the basis of a detection signal of the reducing agent sensor 209.

The state in which the exhaust gas sensor 300 is in an abnormal state means the state of occurrence of an event in which detection accuracy for the exhaust gas state by the exhaust gas sensor 300 is degraded or an event in which the exhaust gas state cannot be detected. For example, in the case of failure of the NOx sensor 301, an abnormality signal indicating the failure of the NOx sensor 301 is transmitted to the determining unit 116. The determining unit 116 determines that the output of the engine 4 is limited when it is determined that the NOx sensor 301 cannot detect the NOx concentration on the basis of the acquired abnormality signal. Additionally, even in the case of failure of the intake air flow rate sensor 305 or in the case of failure of the atmospheric pressure sensor 306, an abnormality signal is transmitted to the determining unit 116. The determining unit 116 determines that the output of the engine 4 is limited when it is determined on the basis of the acquired abnormality signal that the flow rate of NOx cannot be calculated on the basis of the detection signal of the intake air flow rate sensor 305 or when it is determined that the flow rate of NOx cannot be estimated on the basis of the detection signal of the atmospheric pressure sensor 306.

<Merging-Separating Control Unit>

The merging-separating control unit 118 outputs a command signal to control the first merging-separating valve 67 on the basis of a determination result of the determination unit 114 and a determination result of the determining unit 116. When the determining unit 116 determines that output of the engine 4 is limited, the merging-separating control unit 118 outputs, to the first merging-separating valve 67, a command signal to control the first merging-separating valve 67 so as to perform switching to the merged state.

In the present embodiment, when the determining unit 116 determines that the output of the engine 4 is limited even though the determination unit 114 determines to perform switching to the separated state, the merging-separating control unit 118 outputs, to the first merging-separating valve 67, a command signal to control the first merging-separating valve 67 so as to perform switching to the merged state.

When the determining unit 116 determines that the output of the engine 4 is not limited, the merging-separating control unit 118 outputs, on the basis of the determination result of the determination unit 114, a command signal to control the first merging-separating valve 67 to the first merging-separating valve 67 so as to perform switching to any one of the merged state and the separated state.

<Exhaust Gas Treatment Control Unit>

The exhaust gas treatment control unit 120 outputs a command signal to control the exhaust gas treatment device 200. The exhaust gas treatment control unit 120 acquires a detection signal of the exhaust gas sensor 300 and determines a supply amount of the reducing agent R to be supplied to the reducing catalyst 203 on the basis of the detection signal of the exhaust gas sensor 300. The exhaust gas treatment control unit 120 outputs a command signal to control, for example, the supply pump 207 such that the determined supply amount of the reducing agent R is supplied.

<Engine Control Unit>

The engine control unit 122 controls output of the engine 4. The engine control unit 122 controls the output of the engine 4 by outputting a command signal to the fuel injection device 17 to control a fuel injection amount to the engine 4.

In the present embodiment, when the exhaust gas treatment device 200 is in an abnormal state, the engine control unit 122 limits output of the engine 4 by controlling the fuel injection amount to the engine 4. Furthermore, when the exhaust gas sensor 300 is in an abnormal state, the engine control unit 122 limits output of the engine 4 by controlling the fuel injection amount to the engine 4. The engine control unit 122 decreases the output of the engine 4 by decreasing the fuel injection amount injected from the fuel injection device 17. Furthermore, when the exhaust gas is not normally controlled, the engine control unit 122 limits the output of the engine 4. Additionally, the engine control unit 122 limits the output of the engine 4 when the engine 4 cannot be protected, for example, when at least one of the outside air temperature sensor 307 an the coolant temperature sensor 308 which constitute the part of the exhaust gas sensor 300, and an engine hydraulic sensor not illustrated is in an abnormal state.

As described above, the state in which the exhaust gas treatment device 200 is in an abnormal state means the state of occurrence of an event in which the treatment performance (purification performance) for the exhaust gas by the exhaust gas treatment device 200 is degraded or may be degraded. When the engine 4 is actuated with high output although the exhaust gas treatment device 200 is in an abnormal state, a large amount of exhaust gas discharged from the engine 4 cannot be sufficiently purified. As a result, a large amount of exhaust gas not sufficiently purified is emitted to an atmospheric space. Therefore, when it is determined that the exhaust gas treatment device 200 is in an abnormal state, the engine control unit 122 limits the output of the engine 4 by decreasing the fuel injection amount to the engine 4. For example, when it is determined that the amount of the reducing agent R stored in the reducing agent tank 205 is decreased to an amount smaller than the allowable value on the basis of a detection signal of the reducing agent sensor 209, the engine control unit 122 decreases the output of the engine 4. Consequently, an amount of the exhaust gas discharged from the engine 4 becomes a small amount, and it is possible to prevent a large amount of exhaust gas not sufficiently purified from being emitted to the atmospheric space.

As described above, the state in which the exhaust gas sensor 300 is in an abnormal state means the state of occurrence of an event in which detection accuracy for an exhaust gas state by the exhaust gas sensor 300 is degraded or an event in which the exhaust gas state cannot be detected. When the exhaust gas sensor 300 is in an abnormal state, it is difficult for the exhaust gas treatment control unit 120 to determine an appropriate supply amount of the reducing agent R to be supplied to the reducing catalyst 203 on the basis of the detection signal of the exhaust gas sensor 300. For example, when the supplied reducing agent R is excessive, there is higher possibility that ammonia may be emitted to the atmospheric space together with the exhaust gas. On the other hand, when the supplied reducing agent R is too little, there is higher possibility that NOx is not sufficiently decreased and emitted to the atmospheric space. Therefore, when it is determined that the exhaust gas sensor 300 is in an abnormal state, the engine control unit 122 limits output of the engine 4 by decreasing the fuel injection amount to the engine 4. For example, when an abnormality signal indicating failure of the NOx sensor 301 is acquired, the engine control unit 122 decreases the output of the engine 4. The exhaust gas treatment control unit 120 estimates the flow rate of NOx contained in the exhaust gas from the engine 4 having the output decreased, and can determine the supply amount of the reducing agent R such that NOx contained in the exhaust gas is decreased.

Figure 6:
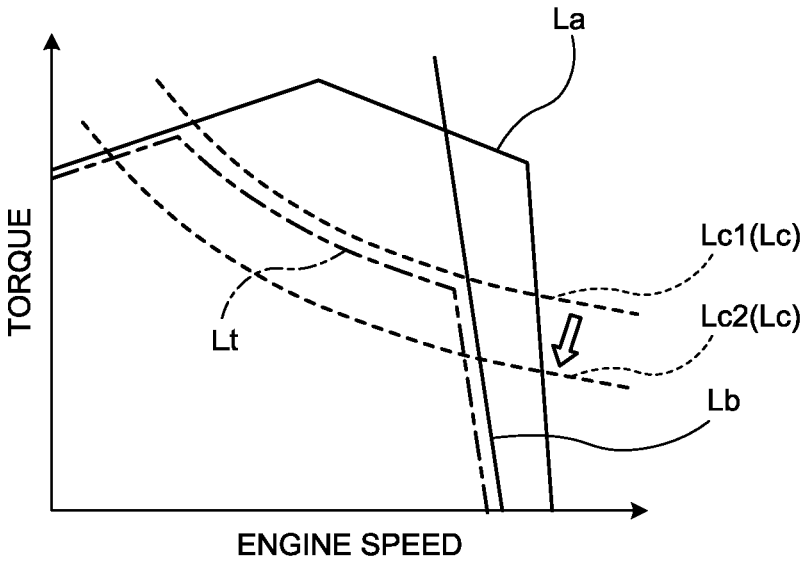
FIG. 6 is a diagram illustrating an exemplary torque chart of an engine according to the present embodiment.

FIG. 6 is a diagram illustrating an exemplary torque chart of the engine 4 according to the present embodiment. An upper limit torque characteristic of the engine 4 is defined by a maximum output torque line La illustrated in FIG. 6. A droop characteristic of the engine 4 is defined by an engine droop line Lb illustrated in FIG. 6. Engine target output is defined by an equal output line Lc illustrated in FIG. 6.

The engine control unit 122 controls the engine 4 on the basis of the upper limit torque characteristic, droop characteristic, and engine target output. The engine control unit 122 controls the engine 4 such that the engine speed and torque of the engine 4 do not exceed the maximum output torque line La, engine droop line Lb, and equal output line Lc.

In other words, the engine control unit 122 outputs a command signal to control the fuel injection amount to the engine 4 such that the engine speed and torque of the engine 4 do not exceed an engine output torque line Lt defined by the maximum output torque line La, engine droop line Lb, and equal output line Lc.

When output of the engine 4 is not limited, the engine control unit 122 sets output of the engine 4 to target output indicated by an equal output line Lc1. When the output of the engine 4 is not limited, the engine control unit 122 adjusts the fuel injection amount to the engine 4 such that the engine speed and torque of the engine 4 do not exceed the equal output line Lc1.

When at least one of the exhaust gas treatment device 200 and the exhaust gas sensor 300 is in an abnormal state and it is necessary to limit the output of the engine 4, the engine control unit 122 sets the output of the engine 4 to target output indicated by an equal output line Lc2. The output of the engine 4 indicated by the equal output line Lc2 is smaller than the output of the engine 4 indicated by the equal output line Lc1. When the output of the engine 4 is limited, the engine control unit 122 adjusts the fuel injection amount to the engine 4 such that the engine speed and torque of the engine 4 do not exceed the equal output line Lc2.

[Control Method]

Figure 7:
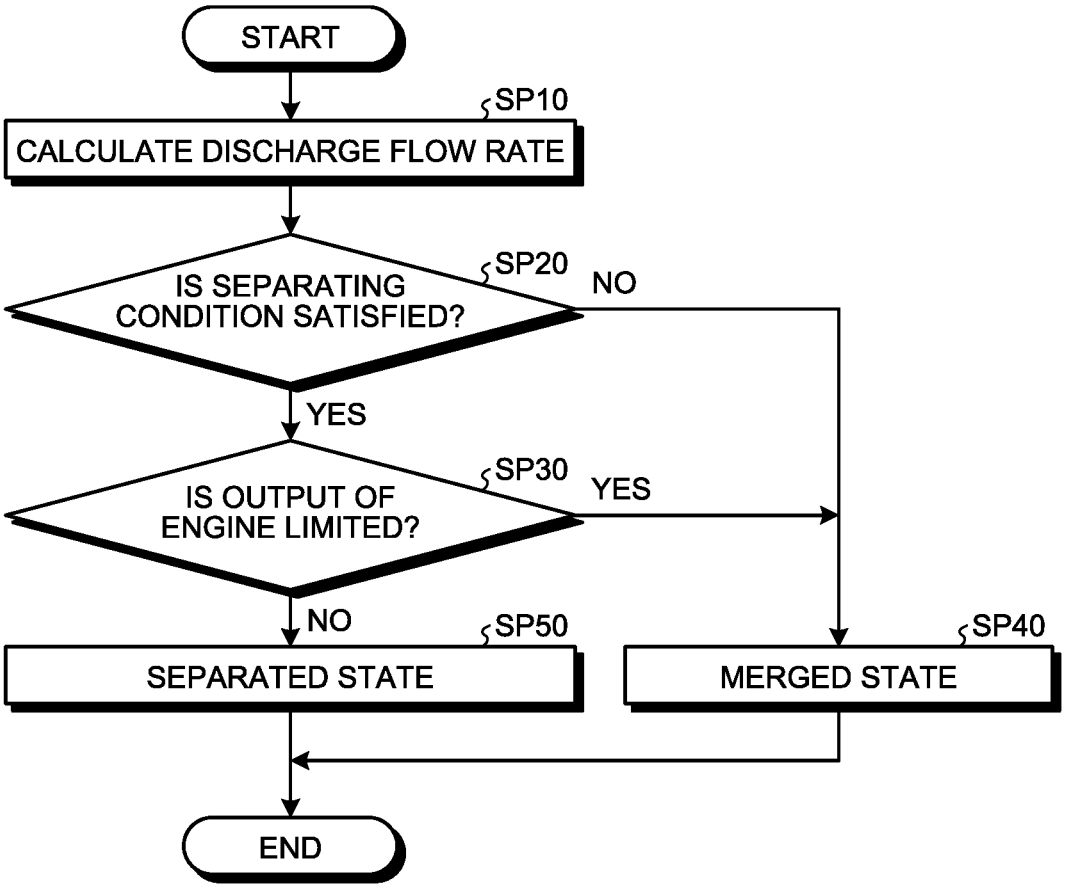
FIG. 7 is a flowchart illustrating an exemplary control method for the work machine according to the present embodiment.

FIG. 7 is a flowchart illustrating an exemplary control method for the excavator 1 according to the present embodiment. The distribution flow rate calculation unit 112 calculates the distribution flow rate Qa (Qabk, Qaar, Qabm) (step SP10).

The determination unit 114 compares the distribution flow rate Qa calculated in the distribution flow rate calculation unit 112 with the threshold value Qs and determines whether the separating conditions by which switching to the separated state can be determined are satisfied (step SP20).

In step SP20, in the case of determining that the separating conditions are not satisfied (step SP20: No), the determination unit 114 determines to perform switching to the merged state. The merging-separating control unit 118 outputs a command signal to the first merging-separating valve 67 so as to perform switching to the merged state. Consequently, the hydraulic system 1000A is actuated in the merged state (step SP40).

Meanwhile, when the hydraulic system 1000A is actuated in the merged state at the time of determining whether the separating conditions are satisfied in step SP20, the merging-separating control unit 118 controls the first merging-separating valve 67 such that the merged state is kept. When the hydraulic system 1000A is actuated in the separated state at the time of determining whether the separating conditions are satisfied, the merging-separating valve control unit 118 controls the first merging-separating valve 67 so as to perform switching from the merged state to the separated state.

In the case of determining in step SP20 that the separating conditions are satisfied (step SP20: Yes), the determination unit 114 determines to perform switching to the separated state. The determining unit 116 determines whether output of the engine 4 is limited (step SP30).

For example, in the case where the amount of the reducing agent R stored in the reducing agent tank 205 is less than the allowable value, an abnormality signal indicating that the exhaust gas treatment device 200 is in an abnormal state is transmitted to the determining unit 116. Furthermore, when the exhaust gas sensor 300 is in an abnormal state, an abnormality signal indicating that the exhaust gas sensor 300 is in an abnormal state is transmitted to the determining unit 116. These abnormality signals are limiting signals indicating that the output of the engine 4 is limited. When the limiting signal is acquired, the determining unit 116 determines that the output of the engine 4 is limited.

In the case of determining in step SP30 that the output of the engine 4 is not limited (step SP30: No), the merging-separating control unit 118 outputs a command signal to the first merging-separating valve 67 so as to perform switching to the separated state. Consequently, the hydraulic system 1000A is actuated in the separated state (step SP50).

In the case of determining in step SP30 that the output of the engine 4 is limited (step SP30: Yes), the merging-separating control unit 118 outputs a command signal to the first merging-separating valve 67 so as to perform switching to the merged state. Consequently, the hydraulic system 1000A is actuated in the merged state (step SP40).

When the hydraulic system 1000A is actuated in the merged state and it is determined that the output of the engine 4 is limited, the merging-separating control unit 118 controls the first merging-separating valve 67 such that the merged state is kept. In the case of determining in step SP30 that the output of the engine 4 is limited while the hydraulic system 1000A is actuated in the separated state, the merging-separating control unit 118 controls the first merging-separating valve 67 so as to perform switching from the separated state to the merged state.

When the hydraulic system 1000A is actuated in the merged state (step SP40), the hydraulic fluid discharged from the first hydraulic pump 31 and the hydraulic fluid discharged from the second hydraulic pump 32 are supplied to each of the bucket cylinder 21, arm cylinder 22, and boom cylinder 23.

When the hydraulic system 1000A is actuated in the separated state (step SP50), the hydraulic fluid discharged from the first hydraulic pump 31 is supplied to the bucket cylinder 21 and the arm cylinder 22, and the hydraulic fluid discharged from the second hydraulic pump 32 is supplied to the boom cylinder 23.

[Effects]

As described above, according to the present embodiment, when output (engine speed) of the engine 4 is limited in the control system 1000 where the state can be switched between the merged state and the separated state, the state in the hydraulic system 1000A is switched to the merged state. In the case where the state is switched to the separated state in the hydraulic system 1000A when output of the engine 4 is decreased, the flow rate of the hydraulic fluid supplied to each of the bucket cylinder 21 and the arm cylinder 22 is decreased. As a result, an actuation speed of the bucket 21 or an actuation speed of the arm 22 may be decreased and workability of the excavator 1 may be degraded. In the present embodiment, when the output of the engine 4 is limited, the state of the hydraulic system 1000A is restricted from being switched to the separated state, and is switched to the merged state, and therefore, the flow rate of the hydraulic fluid supplied to each of the bucket cylinder 21 and the arm cylinder 22 is prevented from being decreased. Therefore, workability of the excavator 1 is prevented from being degraded.

Furthermore, the separating conditions are not satisfied even when the hydraulic system 1000A is switched to the separated state even in the case where the output (engine speed) of the engine 4 is decreased, and the state can be easily switched back to the merged state from the separated state. In the case where a difference between the pressure of the discharge hydraulic fluid from the first hydraulic pump 31 and the pressure of the discharge hydraulic fluid from the second hydraulic pump 32 is large when the state is switched back to the merged state from the separated state, there may be possibility of occurrence of shock. In the present embodiment, when output of the engine 4 is decreased, the state of the hydraulic system 1000A is switched to the merged state, and therefore, occurrence of such shock is suppressed.

Furthermore, in the present embodiment, when the exhaust gas treatment device 200 is in an abnormal state, it is determined that the output of the engine 4 is limited. Since the output of the engine 4 is limited when the exhaust gas treatment device 200 is in an abnormal state, a large amount of NOx is prevented from being emitted to the atmospheric space.

Moreover, in the present embodiment, when the exhaust gas sensor 300 is in an abnormal state, output of the engine 4 is limited. Since the output of the engine 4 is limited when the exhaust gas sensor 300 is in an abnormal state, ammonia or NOx is prevented from being emitted to a standby space.

Additionally, in the present embodiment, when it is determined that output of the engine 4 is limited even in the case where the separating conditions are satisfied, the state in the hydraulic system 1000A is switched to the merged state. Therefore, the flow rate of the hydraulic fluid supplied to each of the bucket cylinder 21 and the arm cylinder 22 is prevented from being decreased, and workability of the excavator 1 is prevented from being degraded.

Moreover, in the present embodiment, output of the engine 4 is limited by decreasing the fuel injection amount to the engine 4. Consequently, the amount of generated NOx is decreased.

Meanwhile, in the above embodiment, it is assumed that the threshold value Qs used to determine whether to actuate the first merging-separating valve 67 is the maximum discharge flow rate Qmax. The threshold value Qs may also be a value smaller than the maximum discharge flow rate Qmax.

Meanwhile, in the above embodiment, it is assumed that the work machine 1 is the excavator 1 of the hybrid system. The work machine 1 may not necessarily be the excavator 1 of the hybrid system. In the above-described embodiment, it is assumed that the upper swing body 2 is swung by the electric motor 25, but may also be swung by a hydraulic motor. The hydraulic motor may calculate a distribution flow rate and pump output by including a swing motor in either the first hydraulic actuator or the second hydraulic actuator.

Meanwhile, in the above embodiment, it is assumed that the control system 1000 is applied to the excavator 1. The work machine to which the control system 1000 is applied is not limited to the excavator 1, and the control system can be widely applied to hydraulically driven work machines other than the excavator.

REFERENCE SIGNS LIST

1 EXCAVATOR (WORK MACHINE)
2 UPPER SWING BODY
3 LOWER TRAVELING BODY
3C CRAWLER
4 ENGINE
4R ENGINE SPEED SENSOR
4S OUTPUT SHAFT
5 OPERATION DEVICE
5L LEFT OPERATING LEVER
5R RIGHT OPERATING LEVER
6 OPERATING ROOM
6S OPERATOR'S SEAT
7 MACHINE ROOM
8 FUEL TANK
9 HYDRAULIC FLUID TANK
10 WORK UNIT
11 BUCKET
12 ARM
13 BOOM
14 STORAGE BATTERY
14C TRANSFORMER
15G FIRST INVERTER
15R SECOND INVERTER
16 ROTATION SENSOR
17 FUEL INJECTION DEVICE
17A ACCUMULATOR
17B INJECTOR
18 INTAKE PIPE
19 EXHAUST PIPE
20 HYDRAULIC CYLINDER
21 BUCKET CYLINDER
21A FIRST BUCKET FLOW PATH
21B SECOND BUCKET FLOW PATH
21C CAP-SIDE SPACE
21L ROD-SIDE SPACE
22 ARM CYLINDER
22A FIRST ARM FLOW PATH
22B SECOND ARM FLOW PATH
22C CAP-SIDE SPACE
22L ROD-SIDE SPACE
23 BOOM CYLINDER
23A FIRST BOOM FLOW PATH
23B SECOND BOOM FLOW PATH
23C CAP-SIDE SPACE
23L ROD-SIDE SPACE
24 HYDRAULIC MOTOR
25 ELECTRIC MOTOR
27 GENERATOR MOTOR
29 COMMON RAIL CONTROL UNIT
30 HYDRAULIC PUMP
30A SWASH PLATE

30S SWASH PLATE ANGLE SENSOR
31 FIRST HYDRAULIC PUMP
31A SWASH PLATE
31B SERVO MECHANISM
31S INCLINATION ANGLE SENSOR
32 SECOND HYDRAULIC PUMP
32A SWASH PLATE
32B SERVO MECHANISM
32S INCLINATION ANGLE SENSOR
33 THROTTLE DIAL
34 WORK MODE SELECTOR
35 AIR CLEANER
40 HYDRAULIC CIRCUIT
41 FIRST HYDRAULIC PUMP FLOW PATH
42 SECOND HYDRAULIC PUMP FLOW PATH
43 FIRST SUPPLY FLOW PATH
44 SECOND SUPPLY FLOW PATH
45 THIRD SUPPLY FLOW PATH
46 FOURTH SUPPLY FLOW PATH
47 FIRST BRANCH FLOW PATH
48 SECOND BRANCH FLOW PATH
49 THIRD BRANCH FLOW PATH
50 FOURTH BRANCH FLOW PATH
51 FIFTH BRANCH FLOW PATH
52 SIXTH BRANCH FLOW PATH
53 DISCHARGE FLOW PATH
55 MERGING FLOW PATH
60 MAIN OPERATION VALVE
61 FIRST MAIN OPERATION VALVE
62 SECOND MAIN OPERATION VALVE
63 THIRD MAIN OPERATION VALVE
67 FIRST MERGING-SEPARATING VALVE (SWITCHING DEVICE)
68 SECOND MERGING-SEPARATING VALVE
69 UNLOAD VALVE
70 PRESSURE COMPENSATING VALVE
71, 72, 73, 74, 75, 76 PRESSURE COMPENSATING VALVE
80 LOAD PRESSURE SENSOR
81 BUCKET LOAD PRESSURE SENSOR
81C, 81L BUCKET LOAD PRESSURE SENSOR
82 ARM LOAD PRESSURE SENSOR
82C, 82L ARM LOAD PRESSURE SENSOR
83 BOOM LOAD PRESSURE SENSOR
83C, 83L BOOM PRESSURE SENSOR
90 OPERATION AMOUNT SENSOR
91 BUCKET OPERATION AMOUNT SENSOR
92 ARM OPERATION AMOUNT SENSOR
93 BOOM OPERATION AMOUNT SENSOR
100 CONTROL DEVICE
100A PUMP CONTROLLER
100B HYBRID CONTROLLER
100C ENGINE CONTROLLER
101 ARITHMETIC PROCESSING DEVICE
102 STORAGE DEVICE
103 INPUT/OUTPUT INTERFACE DEVICE
112 DISTRIBUTION FLOW RATE CALCULATION UNIT
114 DETERMINATION UNIT
116 DETERMINING UNIT
118 MERGING-SEPARATING CONTROL UNIT
120 EXHAUST GAS TREATMENT CONTROL UNIT
122 ENGINE CONTROL UNIT
200 EXHAUST GAS TREATMENT DEVICE
201 FILTER UNIT
202 PIPE LINE
203 REDUCING CATALYST
204 REDUCING AGENT SUPPLY DEVICE
205 REDUCING AGENT TANK
206 SUPPLY PIPE
207 SUPPLY PUMP
208 INJECTION NOZZLE
209 REDUCING AGENT SENSOR
300 EXHAUST GAS SENSOR
301 NOx SENSOR
302 PRESSURE SENSOR
303 TEMPERATURE SENSOR
304 PRESSURE SENSOR
305 INTAKE AIR FLOW RATE SENSOR
306 ATMOSPHERIC PRESSURE SENSOR
307 OUTSIDE AIR TEMPERATURE SENSOR
308 COOLANT TEMPERATURE SENSOR
701 SHUTTLE VALVE
702 SHUTTLE VALVE
800 DISCHARGE PRESSURE SENSOR
801 DISCHARGE PRESSURE SENSOR
802 DISCHARGE PRESSURE SENSOR
1000 CONTROL SYSTEM
1000A HYDRAULIC SYSTEM
1000B ELECTRIC SYSTEM
Br1 FIRST BRANCH PORTION
Br2 SECOND BRANCH PORTION
Br3 THIRD BRANCH PORTION
Br4 FOURTH BRANCH PORTION
R REDUCING AGENT
RX SWING SHAFT

The invention claimed is:

1. A control system comprising:

an engine;

a first hydraulic pump and a second hydraulic pump driven by the engine;

a switching device provided in a flow path that connects the first hydraulic pump to the second hydraulic pump, and configured to perform switching between a merged state in which the flow path is opened and a separated state in which the flow path is closed;

a first hydraulic actuator to which hydraulic fluid discharged from the first hydraulic pump is supplied in the separated state;

a second hydraulic actuator to which hydraulic fluid discharged from the second hydraulic pump is supplied in the separated state;

a determining unit configured to determine whether an output of the engine is limited;

a merging-separating control unit configured to control the switching device so as to perform switching to the merged state when the determining unit determines that the output of the engine is limited; and an exhaust gas treatment device configured to treat an exhaust gas of the engine, wherein the determining unit determines that the output of the engine is limited when it is determined that the exhaust gas treatment device is in an abnormal state which is the state of occurrence of an event in which a treatment performance for the exhaust gas by the exhaust gas treatment device is degraded.

2. The control system according to claim 1, further comprising an exhaust gas sensor configured to detect a state of the engine, wherein the determining unit determines that the output of the engine is limited when it is determined that the exhaust gas sensor is in an abnormal state.

3. The control system according to claim 1, further comprising:

a distribution flow rate calculation unit configured to calculate a distribution flow rate of the hydraulic fluid to be supplied to each of the first hydraulic actuator and the second hydraulic actuator on the basis of an operation amount of an operation device operated in order to drive each of the first hydraulic actuator and the second hydraulic actuator; and a determination unit configured to determine to perform switching to the separated state on the basis of the distribution flow rate;

wherein the merging-separating control unit controls the switching device so as to perform switching to the merged state when the determining unit determines that the output of the engine is limited even though the determination unit determines to perform switching to the separated state.

4. The control system according to claim 1, further comprising an engine control unit configured to limit the output of the engine by controlling a fuel injection amount to the engine.

5. A work machine comprising a control system according to claim 1.

6. A work machine according to claim 5, further comprising a work unit including a first work unit element driven by the first hydraulic actuator and a second work unit element driven by the second hydraulic actuator, wherein the first work unit element includes a bucket and an arm connected to the bucket, the second work unit element includes a boom connected to the arm, the first hydraulic actuator includes a bucket cylinder that drives the bucket and an arm cylinder that drives the arm, and the second hydraulic actuator includes a boom cylinder that drives the boom.

7. A control method comprising:

outputting a command signal to a switching device so as to perform switching to a merged state at a time of acquiring a limiting signal indicating that an output of an engine that drives a first hydraulic pump and a second hydraulic pump is limited, the switching device being configured to perform switching between the merged state in which the flow path that connects the first hydraulic pump to the second hydraulic pump is opened and a separated state in which the flow path is closed; and supplying, in the merged state, each of a first hydraulic actuator and a second hydraulic actuator with hydraulic fluid discharged from the first hydraulic pump and hydraulic fluid discharged from the second hydraulic pump, wherein determining that the output of the engine is limited when it is determined that an exhaust gas treatment device, configured to treat an exhaust gas of the engine, is in an abnormal state which is the state of occurrence of an event in which a treatment performance for the exhaust gas by the exhaust gas treatment device is degraded.

8. The control system according to claim 1, wherein the exhaust gas treatment device includes a urea selective catalytic reduction (SCR) system to reduce and purify nitrogen oxides (NOx) contained in the exhaust gas by utilizing a selective catalyst and a reducing agent.

9. The control system according to claim 1, wherein the exhaust gas treatment device includes: a filter unit connected to an exhaust pipe and configured to collect particulates contained in the exhaust gas; a reducing catalyst connected to the filter unit via a pipe line and configured to reduce NOx contained in the exhaust gas; and a reducing agent supply device to supply a reducing agent.

10. The control system according to claim 9, wherein the filter unit includes a diesel particulate filter (DPF) and collects the particulates contained in the exhaust gas.

11. The control system according to claim 9, wherein the reducing agent is urea (aqueous urea).

12. The control system according to claim 9, wherein the reducing agent supply device includes: a reducing agent tank to store the reducing agent; a supply pipe connected to the reducing agent tank; a supply pump provided in the supply pipe; and an injection nozzle connected to the supply pipe.

13. The control system according to claim 12, wherein a supply amount (injection amount) of the reducing agent by the reducing agent supply device is controlled by a control device.

14. The control system according to claim 12, wherein a reducing agent sensor that detects an amount (liquid level) of the reducing agent is provided in the reducing agent tank of the reducing agent supply device.

15. The control system according to claim 2, wherein the exhaust gas sensor includes an NOx sensor that detects a concentration of NOx contained in an exhaust gas, a pressure sensor and a pressure sensor each of which detects a pressure of the exhaust gas, a temperature sensor that detects a temperature of the exhaust gas, and an intake air flow rate sensor that detects a flow rate of the air taken into the engine.

16. The control system according to claim 2, wherein the control device may calculate the flow rate of the exhaust gas in the pipe line on the basis of the detection signal of the intake air flow rate sensor and a fuel injection amount supplied from the fuel injection device to the engine.

17. The control system according to claim 2, wherein the control device may also control the supply amount of the reducing agent to be supplied to the reducing catalyst on the basis of the detection signal of the NOx sensor, detection signal of the pressure sensor, detection signal of the temperature sensor, and detection signal of the pressure sensor.

18. A control system comprising:

an engine;

a first hydraulic pump and a second hydraulic pump driven by the engine;

a switching device provided in a flow path that connects the first hydraulic pump to the second hydraulic pump, and configured to perform switching between a merged state in which the flow path is opened and a separated state in which the flow path is closed;

a first hydraulic actuator to which hydraulic fluid discharged from the first hydraulic pump is supplied in the separated state;

a second hydraulic actuator to which hydraulic fluid discharged from the second hydraulic pump is supplied in the separated state;

a determining unit configured to determine whether an output of the engine is limited;

a merging-separating control unit configured to control the switching device so as to perform switching to the merged state when the determining unit determines that the output of the engine is limited;

an exhaust gas treatment device configured to treat an exhaust gas of the engine, wherein the determining unit determines that the output of the engine is limited when it is determined that the exhaust gas treatment device is in an abnormal state which is the state of occurrence of an event in which a treatment performance for the exhaust gas by the exhaust gas treatment device is degraded; and an engine control unit configured to limit the output of the engine by controlling a fuel injection amount to the engine.

* * * * *